US009186710B2

(12) United States Patent
Akashi et al.

(10) Patent No.: US 9,186,710 B2
(45) Date of Patent: Nov. 17, 2015

(54) METHOD FOR COOLING HOT-ROLLED STEEL SHEET

(71) Applicant: NIPPON STEEL & SUMITOMO METAL CORPORATION, Tokyo (JP)

(72) Inventors: Tooru Akashi, Tokyo (JP); Shingo Kuriyama, Tokyo (JP); Takeo Itoh, Tokyo (JP); Fuminori Tasaki, Tokyo (JP); Koji Noguchi, Tokyo (JP); Hitoshi Nikaido, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 86 days.

(21) Appl. No.: 14/111,457

(22) PCT Filed: Dec. 6, 2012

(86) PCT No.: PCT/JP2012/081670

§ 371 (c)(1),
(2) Date: Oct. 11, 2013

(87) PCT Pub. No.: WO2014/087524

PCT Pub. Date: Jun. 12, 2014

(65) Prior Publication Data

US 2014/0060139 A1 Mar. 6, 2014

(51) Int. Cl.
*B21B 1/26* (2006.01)
*B21B 37/44* (2006.01)
(Continued)

(52) U.S. Cl.
CPC . *B21B 1/26* (2013.01); *B21B 37/32* (2013.01); *B21B 37/44* (2013.01); *B21B 37/76* (2013.01); *B21B 1/24* (2013.01); *B21B 38/006* (2013.01); *B21B 45/0218* (2013.01)

(58) Field of Classification Search
CPC ..... B21B 1/26; B21B 37/26; B21B 37/32; B21B 37/44; B21B 37/76; B21B 2263/06; B21B 2236/04; B21B 38/006; B21B 38/02; B21B 45/0218
USPC ..... 72/8.1, 8.5, 11.3, 201; 700/153
See application file for complete search history.

(56) References Cited

U.S. PATENT DOCUMENTS 4,047,985 A * 9/1977 Greenberger ..... 134/15
4,274,273 A * 6/1981 Fapiano et al. ..... 72/8.5
(Continued)

FOREIGN PATENT DOCUMENTS

CN 101780478 A 7/2010
CN 102166582 A 8/2011
(Continued)

OTHER PUBLICATIONS

High Strength and Ultra High Strength Steels for Weight Reduction in Structural and Safety Related Applications 29th Int. Symposium on Automotive Technology &Automation (ISATA) Florens, Jun. 1996 by Jan-Olaf Sperle abd Kennet Olsson.*
(Continued)

*Primary Examiner* — A. Dexter Tugbang
*Assistant Examiner* — Joshua D Anderson
(74) *Attorney, Agent, or Firm* — Birch, Stewart, Kolasch & Birch, LLP

(57) ABSTRACT

The method for cooling a hot-rolled steel sheet of the invention includes a target ratio-setting process in which a top and bottom heat transfer coefficient ratio X1, at which a temperature standard deviation Y becomes a minimum value Ymin, is set as a target ratio Xt based on correlation data between a top and bottom heat transfer coefficient ratio X of the hot-rolled steel sheet and the temperature standard deviation Y of the hot-rolled steel sheet; and a cooling control process in which at least one of an amount of heat dissipated from a top surface by cooling and an amount of heat dissipated from a bottom surface by cooling of the hot-rolled steel sheet in the cooling section is controlled so that the top and bottom heat transfer coefficient ratio X of the hot-rolled steel sheet in the cooling section matches the target ratio Xt.

15 Claims, 15 Drawing Sheets

(51) Int. Cl.

| | |
|---|---|
| ***B21B 37/32*** | (2006.01) |
| ***B21B 37/76*** | (2006.01) |
| *B21B 1/24* | (2006.01) |
| *B21B 38/00* | (2006.01) |
| *B21B 45/02* | (2006.01) |

(56) References Cited

U.S. PATENT DOCUMENTS

| | | | | |
|---|---|---|---|---|
| 4,726,213 | A * | 2/1988 | Manchu | 72/9.1 |
| 5,259,229 | A | 11/1993 | Inagaki et al. | |
| 6,615,633 | B1 * | 9/2003 | Akashi et al. | 72/200 |
| 7,577,489 | B2 * | 8/2009 | Fodor et al. | 700/154 |
| 2010/0132426 | A1 * | 6/2010 | Baumgartel et al. | 72/342.2 |
| 2010/0218578 | A1 | 9/2010 | Tachibana | |
| 2010/0219566 | A1 | 9/2010 | Shimoi et al. | |
| 2012/0151981 | A1 | 6/2012 | Yoshii et al. | |
| 2012/0216924 | A1 | 8/2012 | Ota | |
| 2012/0318414 | A1 | 12/2012 | Tachibana et al. | |
| 2012/0318478 | A1 * | 12/2012 | Weinzierl | 165/104.11 |
| 2014/0053886 | A1 * | 2/2014 | Akashi et al. | 134/57 R |
| 2014/0060139 | A1 * | 3/2014 | Akashi et al. | 72/201 |

FOREIGN PATENT DOCUMENTS

| | | | |
|---|---|---|---|
| CN | 102481610 | A | 5/2012 |
| CN | 102596440 | A | 7/2012 |
| CN | 102781598 | A | 11/2012 |
| JP | 2-75409 | A | 3/1990 |
| JP | 2-179819 | A | 7/1990 |
| JP | 2-179825 | A | 7/1990 |
| JP | 3-18416 | A | 1/1991 |
| JP | 5-337505 | A | 12/1993 |
| JP | 6-228651 | A | 8/1994 |
| JP | 6-228652 | A | 8/1994 |
| JP | 6-228653 | A | 8/1994 |
| JP | 6-328117 | A | 11/1994 |
| JP | 7-63750 | * | 7/1995 |
| JP | 7-214133 | A | 8/1995 |
| JP | 10-166023 | A | 6/1998 |
| JP | 10-263696 | A | 10/1998 |
| JP | 11-347629 | A | 12/1999 |
| JP | 2000-1719 | A | 1/2000 |
| JP | 2000-317513 | A | 11/2000 |
| JP | 2002-45908 | A | 2/2002 |
| JP | 2003-48003 | A | 2/2003 |
| JP | 2005-66614 | A | 3/2005 |
| JP | 2005-74463 | A | 3/2005 |
| JP | 3657750 | B2 | 6/2005 |
| JP | 2005-271052 | A | 10/2005 |
| JP | 2006-272441 | A | 10/2006 |
| JP | 2006-281271 | A | 10/2006 |
| JP | 2007-216246 | A | 8/2007 |
| JP | 4029871 | B2 | 1/2008 |
| JP | 2009-208086 | A | 9/2009 |
| JP | 2010-105027 | A | 5/2010 |
| JP | 2011-73054 | A | 4/2011 |
| TW | I315683 | B | 10/2009 |
| WO | WO 2009/011070 | A1 | 1/2009 |
| WO | WO 2011104103 | A2 * | 9/2011 |

OTHER PUBLICATIONS

Japanese Notice of Allowance for Japanese Application No. 2012-128595, dated Oct. 7, 2014, with an English translation.
Korean Office Action for Korean Application No. 10-2013-7019174, dated Oct. 28, 2014, with an English translation.
International Search Report, mailed Jan. 22, 2013, issued in PCT/JP2012/081634.
International Search Report, mailed Jan. 22, 2013, issued in PCT/JP2012/081659.
International Search Report, mailed Jan. 22, 2013, issued in PCT/JP2012/081670.
Office Action issued Apr. 23, 2013 in Japanese Patent Application 2012-128595.
Written Opinion of the International Searching Authority, mailed Jan. 22, 2013, issued in PCT/JP2012/081670.
Japanese Office Action for Japanese Application No. 2011-127154, issued Dec. 3, 2013, with an English translation.
Japanese Office Action for Japanese Application No. 2012-128595, issued Jan. 6, 2014, with an English translation.
Japanese Office Action for Japanese Application No. 2012-151025, issued Jan. 6, 2014, with an English translation.
Chinese Office Action and Search Report for Chinese Application No. 201280007157.6, dated Feb. 3, 2015, with an English translation of the Chinese Search Report only.
Taiwanese Notice of Allowance for Taiwanese Application No. 101146085, dated Dec. 30, 2014, with an English translation.
Korean Notice of Allowance dated Apr. 3, 2015, issued in Korean Patent Application No. 10-2013-7019174, with English translation.
Chinese Office Action and search report, issued Feb. 27, 2015, for Chinese Application No. 201280005604.4, along with an English translation of the Chinese Search Report.
Chinese Office Action and Search Report, issued Mar. 17, 2015, for Chinese Application No. 201280010631.0, along with an English translation of the Chinese Search Report.
Taiwanese Office Action dated Jun. 9, 2015, issued in Taiwanese Patent Application No. 101146092 (with partial translation).

* cited by examiner

FIG. 21 - PRIOR ART
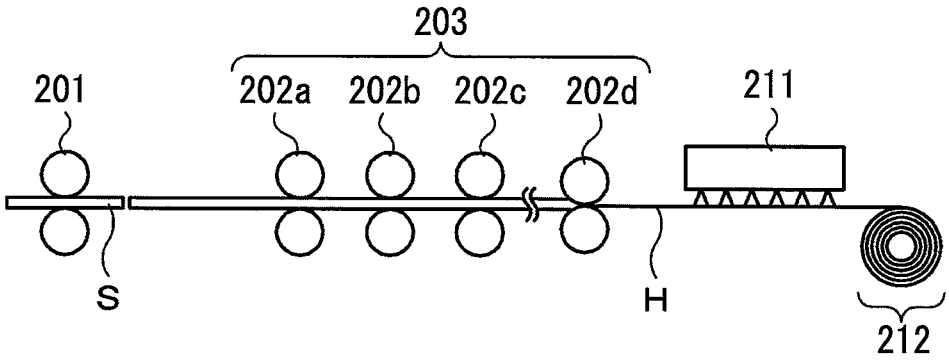
FIG. 22 - PRIOR ART
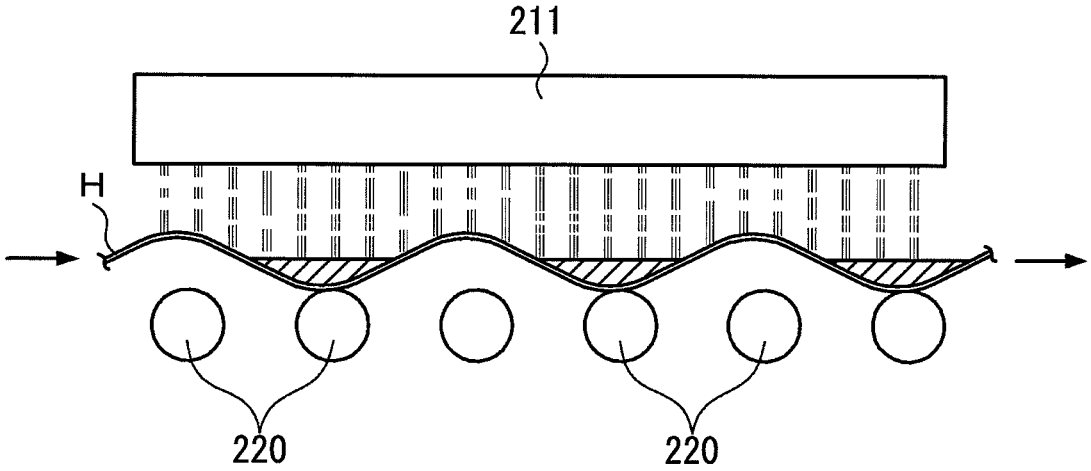

METHOD FOR COOLING HOT-ROLLED STEEL SHEET

TECHNICAL FIELD

The present invention relates to a method for cooling a hot-rolled steel sheet in which a hot-rolled steel sheet hot-rolled using a finishing mill is cooled.

BACKGROUND ART

For example, a hot-rolled steel sheet used in cars, industrial machines and the like is generally manufactured through a rough-rolling process and a finish-rolling process. FIG. 21 is a view schematically illustrating a method for manufacturing a hot-rolled steel sheet of the related art. In the process for manufacturing a hot-rolled steel sheet, first, a slab S obtained by continuously casting molten steel having an adjusted predetermined composition is rolled using a roughing mill 201, and then, furthermore, hot-rolled using a finishing mill 203 constituted by a plurality of rolling stands 202*a* to 202*d*, thereby forming a hot-rolled steel sheet H having a predetermined thickness. In addition, the hot-rolled steel sheet H is cooled using cooling water supplied from a cooling apparatus 211, and then coiled into a coil shape using a coiling apparatus 212.

The cooling apparatus 211 is generally a facility for carrying out so-called laminar cooling on the hot-rolled steel sheet H transported from the finishing mill 203. The cooling apparatus 211 sprays the cooling water on the top surface of the hot-rolled steel sheet H moving on a run-out table from the top in the vertical direction in a water jet form through a cooling nozzle, and, simultaneously, sprays the cooling water on the bottom surface of the hot-rolled steel sheet H through a pipe laminar in a water jet form, thereby cooling the hot-rolled steel sheet H.

In addition, for example, Patent Document 1 discloses a technique of the related art which reduces the difference in surface temperature between the top and bottom surfaces of a thick steel sheet, thereby preventing the shape of the steel sheet from becoming defective. According to the technique disclosed in Patent Document 1, the water volume ratio of cooling water supplied to the top surface and the bottom surface of the steel sheet is adjusted based on the difference in surface temperature obtained by simultaneously measuring the surface temperatures of the top surface and the bottom surface of the steel sheet using a thermometer when the steel sheet is cooled using a cooling apparatus.

In addition, for example, Patent Document 2 discloses a technique that cools a rolled material between two adjacent stands in a finishing mill using a sprayer, thereby beginning and completing the $\gamma$-$\alpha$ transformation of the rolled material so as to prevent sheet-threading performance between the stands from deteriorating.

In addition, for example, Patent Document 3 discloses a technique that measures the steepness at the tip of a steel sheet using a steepness meter installed on the exit side of a mill, and prevents the steel sheet from being perforated by adjusting the flow rate of cooling water to be different in the width direction based on the measured steepness.

Furthermore, for example, Patent Document 4 discloses a technique that aims to solve a wave-shaped sheet thickness distribution in the sheet width direction of a hot-rolled steel sheet and to make uniform the sheet thickness in the sheet width direction, and controls the difference between the maximum heat transmissibility and the minimum heat transmissibility in the sheet width direction of the hot-rolled steel sheet to be in a range of predetermined values.

Here, there are cases in which the hot-rolled steel sheet H manufactured using the manufacturing method illustrated in FIG. 21 forms a wave shape in the rolling direction (the arrow direction in FIG. 22) on transportation rolls 220 in the run-out table (hereinafter sometimes referred to as "ROT") in the cooling apparatus 211 as illustrated in FIG. 22. In this case, the top surface and the bottom surface of the hot-rolled steel sheet H are not uniformly cooled. That is, there was a problem in that, due to cooling deviation caused by the wave shape of the hot-rolled steel sheet H, it became impossible to uniformly cool the steel sheet in the rolling direction.

Therefore, for example, Patent Document 5 discloses a technique that, in a steel sheet formed into a wave shape in the rolling direction, makes uniform the cooling capabilities of top portion cooling and bottom portion cooling so as to minimize the influence of the distance between soaked water on the top portion of the steel sheet and a table roller at the bottom portion in order to uniformly cool the steel sheet.

PRIOR ART DOCUMENT

Patent Document

[Patent Document 1] Japanese Unexamined Patent Application, First Publication No. 2005-74463

[Patent Document 2] Japanese Unexamined Patent Application, First Publication No. H05-337505

[Patent Document 3] Japanese Unexamined Patent Application, First Publication No. 2005-271052

[Patent Document 4] Japanese Unexamined Patent Application, First Publication No. 2003-48003

[Patent Document 5] Japanese Unexamined Patent Application, First Publication No. H06-328117

SUMMARY OF THE INVENTION

Problem that the Invention is to Solve

However, in the cooling method of Patent Document 1, a case of a hot-rolled steel sheet having a wave shape in the rolling direction is not taken into consideration. In the hot-rolled steel sheet H having a wave shape described above, there are cases in which the bottom portion of the wave shape locally comes into contact with the transportation rolls 220 as illustrated in FIG. 22. In addition, there are cases in which the hot-rolled steel sheet H locally comes into contact with aprons (not illustrated in FIG. 22) provided as supports in order to prevent the hot-rolled steel sheet H from dropping between the transportation rolls 220 at the bottom portion of the wave shape. In the wave-shaped hot-rolled steel sheet H, the portions that locally come into contact with the transportation rolls 220 or the aprons become more easily cooled than other portions due to heat dissipation by contact. Therefore, there was a problem in that the hot-rolled steel sheet H was ununiformly cooled. That is, in Patent Document 1, the fact that the wave shape of the hot-rolled steel sheet causes the hot-rolled steel sheet to locally come into contact with the transportation rolls or the aprons and the contact portions becomes easily cooled due to heat dissipation by contact is not taken into consideration. Therefore, there are cases in which it is impossible to uniformly cool a hot-rolled steel sheet having a wave shape formed as described above.

In addition, the technique described in Patent Document 2 is to make (soft) ultra low carbon steel having a relatively low hardness undergo $\gamma$-$\alpha$ transformation between stands in a finishing mill, and does not aim at uniform cooling. In addition, the invention of Patent Document 2 does not relate to cooling in a case in which a rolled material has a wave shape in the rolling direction or a rolled material is a steel material that is so-called high tensile strength steel having a tensile strength (TS) of 800 MPa or more, and therefore there is a concern that uniform cooling may not be possible in a case in which a rolled material is a hot-rolled steel sheet having a wave shape or a steel material having a relatively high hardness.

In addition, in the cooling method of Patent Document 3, the steepness of the steel sheet in the width direction is measured, and the flow rate of cooling water is adjusted in portions having a high steepness. However, when the flow rate of cooling water in the sheet width direction of the steel sheet is changed, it becomes difficult to make uniform the temperature of the steel sheet in the sheet width direction. Furthermore, Patent Document 3 also does not take a hot-rolled steel sheet having a wave shape in the rolling direction into consideration, and there are cases in which it is not possible to uniformly cool a hot-rolled steel sheet as described above.

In addition, the cooling of Patent Document 4 is the cooling of a hot-rolled steel sheet immediately before roll bites in the finishing mill, and therefore it is not possible to apply the cooling to a hot-rolled steel sheet which has undergone finish-rolling so as to have a predetermined thickness. Furthermore, Patent Document 4 also does not take a hot-rolled steel sheet having a wave shape in the rolling direction into consideration, and there are cases in which it is not possible to uniformly cool a hot-rolled steel sheet in the rolling direction as described above.

In addition, in the cooling method of Patent Document 5, the cooling capability of the top portion cooling includes not only cooling by the cooling water supplied to the steel sheet from a top portion water supply nozzle but also cooling by the soaked water in the top portion of the steel sheet. Since the soaked water is influenced by the steepness of the wave shape formed in the steel sheet or the sheet-threading speed of the steel sheet, strictly, it is not possible to specify the cooling capability of the steel sheet by the soaked water. Thus, it is difficult to accurately control the cooling capability of the top portion cooling. Therefore, it is also difficult to make the cooling capabilities of the top portion cooling and the bottom portion cooling equivalence. Furthermore, the patent document describes an example of a method for determining the cooling capabilities when the cooling capabilities of the top portion cooling and the bottom portion cooling are made uniform, but does not disclose ordinary determination methods. Therefore, in the cooling method of Patent Document 5, there are cases in which it is not possible to uniformly cool a hot-rolled steel sheet.

The present invention has been made in consideration of the above problems, and an object of the present invention is to uniformly cool a hot-rolled steel sheet hot-rolled using a finishing mill.

Means for Solving the Problems

The present invention employs the following means for solving the problems and achieving the relevant object.

That is, (1) According to an aspect of the present invention, a method for cooling a hot-rolled steel sheet is provided in which a hot-rolled steel sheet hot-rolled using a finishing mill is cooled in a cooling section provided on a sheet-threading path, including a target ratio-setting process in which a top and bottom heat transfer coefficient ratio X1, at which a temperature standard deviation Y becomes a minimum value Ymin, is set as a target ratio Xt based on correlation data indicating a correlation between a top and bottom heat transfer coefficient ratio X, which is a ratio of heat transfer coefficients of top and bottom surfaces of the hot-rolled steel sheet, and the temperature standard deviation Y during or after cooling of the hot-rolled steel sheet, which have been experimentally obtained in advance under conditions in which steepness and sheet-threading speed of the hot-rolled steel sheet are set to constant values; and a cooling control process in which at least one of an amount of heat dissipated from a top surface by cooling and an amount of heat dissipated from a bottom surface by cooling of the hot-rolled steel sheet in the cooling section is controlled so that the top and bottom heat transfer coefficient ratio X of the hot-rolled steel sheet in the cooling section matches the target ratio Xt.

(2) In the method for cooling a hot-rolled steel sheet according to the above (1), in the target ratio-setting process, a top and bottom heat transfer coefficient ratio X at which the temperature standard deviation Y converges in a range of the minimum value Ymin to the minimum value Ymin+10° C. may be set as the target ratio Xt based on the correlation data.

(3) In the method for cooling a hot-rolled steel sheet according to the above (1) or (2), the correlation data may be prepared respectively for a plurality of conditions in which values of the steepness and the sheet-threading speed are different, and, in the target ratio-setting process, the target ratio Xt may be set based on correlation data matching actually measured values of the steepness and the sheet-threading speed among the plurality of correlation data.

(4) In the method for cooling a hot-rolled steel sheet according to the above (3), the correlation data may be data indicating the correlation between the top and bottom heat transfer coefficient ratio X and the temperature standard deviation Y using a regression formula.

(5) In the method for cooling a hot-rolled steel sheet according to the above (4), the regression formula may be a formula derived using linear regression.

(6) In the method for cooling a hot-rolled steel sheet according to the above (3), the correlation data may be data indicating the correlation between the top and bottom heat transfer coefficient ratio X and the temperature standard deviation Y using a table.

(7) The method for cooling a hot-rolled steel sheet according to the above (1) or (2) may further include a temperature-measuring process in which a temperature of the hot-rolled steel sheet is measured in chronological order on a downstream side of the cooling section; an average temperature value-computing process in which a chronological average value of the temperature is computed based on a measurement result of the temperature; and an amount of heat dissipated by cooling-adjusting process in which a total value of the amount of heat dissipated from the top surface by cooling and the amount of heat dissipated from the bottom surface by cooling of the hot-rolled steel sheet in the cooling section is adjusted so that the chronological average value of the temperature matches a predetermined target temperature.

(8) The method for cooling a hot-rolled steel sheet according to the above (1) or (2) may further include a temperature-measuring process in which a temperature of the hot-rolled steel sheet is measured in chronological order on a downstream side of the cooling section; a changing speed-measuring process in which a changing speed of the hot-rolled steel sheet in a vertical direction is measured in chronological order at a same place as a temperature measurement place of the hot-rolled steel sheet on the downstream side of the cooling section; a control direction-determining process in which, when an upward side of the vertical direction of the hot-rolled steel sheet is set as positive, in an area with a positive changing speed, in a case in which a temperature of the hot-rolled steel sheet is lower than an average temperature in a range of one or more cycles of a wave shape of the hot-rolled steel sheet, at least one of a direction in which the amount of heat dissipated from the top surface by cooling decreases and a direction in which the amount of heat dissipated from the bottom surface by cooling increases is determined as a control direction, in a case in which the temperature of the hot-rolled steel sheet is higher than the average temperature, at least one of a direction in which the amount of heat dissipated from the top surface by cooling increases and a direction in which the amount of heat dissipated from the bottom surface by cooling decreases is determined as the control direction, and, in an area with a negative changing speed, in a case in which the temperature of the hot-rolled steel sheet is lower than the average temperature, at least one of a direction in which the amount of heat dissipated from the top surface by cooling increases and a direction in which the amount of heat dissipated from the bottom surface by cooling decreases is determined as the control direction, in a case in which the temperature of the hot-rolled steel sheet is higher than the average temperature, at least one of a direction in which the amount of heat dissipated from the top surface by cooling decreases and a direction in which the amount of heat dissipated from the bottom surface by cooling increases is determined as the control direction; and an amount of heat dissipated by cooling-adjusting process in which at least one of the amount of heat dissipated from the top surface by cooling and the amount of heat dissipated from the bottom surface by cooling of the hot-rolled steel sheet in the cooling section is adjusted based on the control direction determined in the control direction-determining process.

(9) In the method for cooling a hot-rolled steel sheet according to the above (8), the cooling section may be divided into a plurality of divided cooling sections in a sheet-threading direction of the hot-rolled steel sheet, the temperature and changing speed of the hot-rolled steel sheet may be measured in chronological order at each of borders of the divided cooling sections in the temperature-measuring process and the changing speed-measuring process; increase and decrease directions of the amounts of heat dissipated by cooling from the top and bottom surfaces of the hot-rolled steel sheet may be determined for the respective divided cooling sections based on measurement results of the temperature and changing speeds of the hot-rolled steel sheet at the respective borders of the divided cooling sections in the control direction-determining process; and feedback control or feedforward control may be carried out in order to adjust at least one of the amount of heat dissipated from the top surface by cooling and the amount of heat dissipated from the bottom surface by cooling of the hot-rolled steel sheet at each of the divided cooling sections based on the control direction determined for each of the divided cooling sections in the amount of heat dissipated by cooling-adjusting process.

(10) The method for cooling a hot-rolled steel sheet according to the above (9) may further include a measuring process in which the steepness or the sheet-threading speed of the hot-rolled steel sheet is measured at each of the borders of the divided cooling sections; and an amount of heat dissipated by cooling-correcting process in which at least one of the amount of heat dissipated from the top surface by cooling and the amount of heat dissipated from the bottom surface by cooling of the hot-rolled steel sheet is corrected at each of the divided cooling sections based on measurement results of the steepness or the sheet-threading speeds.

(11) The method for cooling a hot-rolled steel sheet according to the above (1) or (2) may further include a post-cooling process in which the hot-rolled steel sheet is further cooled in order to make the temperature standard deviation of the hot-rolled steel sheet fall into a permissible range on a downstream side of the cooling section.

(12) In the method for cooling a hot-rolled steel sheet according to the above (1) or (2), the sheet-threading speed of the hot-rolled steel sheet in the cooling section may be set in a range of 550 m/min to a mechanical limit speed.

(13) In the method for cooling a hot-rolled steel sheet according to the above (1) or (2), a tensile strength of the hot-rolled steel sheet may be 800 MPa or more.

(14) In the method for cooling a hot-rolled steel sheet according to the above (12), the finishing mill may be constituted by a plurality of rolling stands, and a supplementary cooling process in which the hot-rolled steel sheet is supplementarily cooled between the plurality of rolling stands may be further provided.

(15) In the method for cooling a hot-rolled steel sheet according to the above (1) or (2), a top side cooling apparatus having a plurality of headers that ejects cooling water to a top surface of the hot-rolled steel sheet and a bottom side cooling apparatus having a plurality of headers that ejects cooling water to a bottom surface of the hot-rolled steel sheet may be provided in the cooling section, and the amount of heat dissipated from the top surface by cooling and the amount of heat dissipated from the bottom surface by cooling may be adjusted by carrying out on-off control of the respective headers.

(16) In the method for cooling a hot-rolled steel sheet according to the above (1) or (2), a top side cooling apparatus having a plurality of headers that ejects cooling water to a top surface of the hot-rolled steel sheet and a bottom side cooling apparatus having a plurality of headers that ejects cooling water to a bottom surface of the hot-rolled steel sheet may be provided in the cooling section, and the amount of heat dissipated from the top surface by cooling and the amount of heat dissipated from the bottom surface by cooling may be adjusted by controlling at least one of sprayed water density, pressure and water temperature of each of the headers.

(17) In the method for cooling a hot-rolled steel sheet according to the above (1) or (2), cooling in the cooling section may be carried out at a temperature of the hot-rolled steel sheet in a range of 600° C. or higher.

Effect of the Invention

As a result of thorough investigation of the correlation between the top and bottom heat transfer coefficient ratio X, which is a ratio of heat transfer coefficients of top and bottom surfaces of the hot-rolled steel sheet, and the temperature standard deviation Y during or after cooling of the hot-rolled steel sheet under conditions in which the steepness and the sheet-threading speed of the hot-rolled steel sheet are set to constant values, the present inventors found that the temperature standard deviation Y can be minimized (that is, the hot-rolled steel sheet can be uniformly cooled) by controlling the top and bottom heat transfer coefficient ratio X to a specific value.

Therefore, according to the present invention, since a top and bottom heat transfer coefficient ratio X1, at which the temperature standard deviation Y becomes a minimum value Ymin, is set as the target ratio Xt based on the correlation data of the top and bottom heat transfer coefficient ratio X and the temperature standard deviation Y of the hot-rolled steel sheet, which have been experimentally obtained in advance, and at least one of the amount of heat dissipated from the top surface by cooling and the amount of heat dissipated from the bottom surface by cooling of the hot-rolled steel sheet is controlled so that the top and bottom heat transfer coefficient ratio X of the hot-rolled steel sheet in the cooling section matches the target ratio Xt, it is possible to uniformly cool the hot-rolled steel sheet which has been hot-rolled using a finishing mill so as to have a wave shape.

BRIEF DESCRIPTION OF THE DRAWING

FIG. 21 is an explanatory view illustrating a method for manufacturing the hot-rolled steel sheet H of the related art.

FIG. 22 is an explanatory view illustrating a method for cooling the hot-rolled steel sheet H of the related art.

EMBODIMENT OF THE INVENTION

Hereinafter, as an embodiment of the present invention, a method for cooling a hot-rolled steel sheet which is intended to cool a hot-rolled steel sheet used in, for example, cars and industrial machines will be described with reference to the accompanying drawings.

Figure 1:
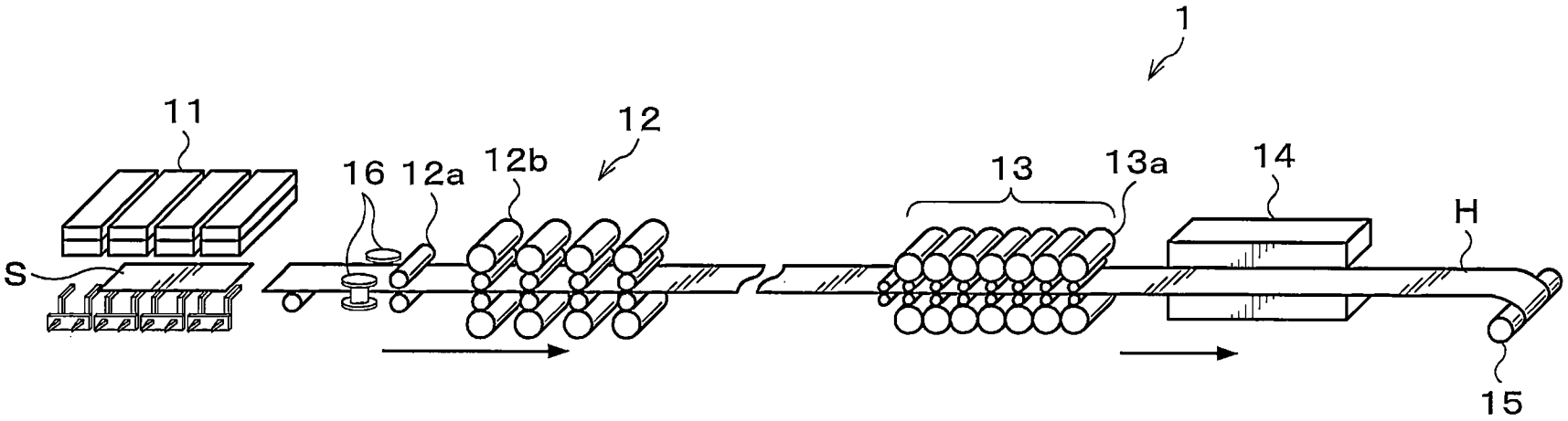
FIG. 1 is an explanatory view illustrating a hot rolling facility 1 for realizing a method for cooling a hot-rolled steel sheet in an embodiment of the present invention.

FIG. 1 schematically illustrates an example of a hot rolling facility 1 for realizing the method for cooling a hot-rolled steel sheet in the present embodiment. The hot rolling facility 1 is a facility aimed to sandwich the top and bottom of a heated slab S using rolls, continuously roll the slab to make the slab as thin as a minimum of 1 mm, and coil the slab.

The hot rolling facility 1 has a heating furnace 11 for heating the slab S, a width-direction mill 16 that rolls the slab S heated in the heating furnace 11 in a width direction, a roughing mill 12 that rolls the slab S rolled in the width direction from the vertical direction so as to produce a rough bar, a finishing mill 13 that further continuously hot-finishing-rolls the rough bar to a predetermined thickness, a cooling apparatus 14 that cools the hot-rolled steel sheet H hot-finishing-rolled using the finishing mill 13 using cooling water, and a coiling apparatus 15 that coils the hot-rolled steel sheet H cooled using the cooling apparatus 14 into a coil shape.

The heating furnace 11 is provided with a side burner, an axial burner and a roof burner that heat the slab S brought from the outside through a charging hole by blowing flame. The slab S brought into the heating furnace 11 is sequentially heated in respective heating areas formed in respective zones, and, furthermore, a heat-retention treatment for enabling transportation at an optimal temperature is carried out by uniformly heating the slab S using the roof burner in a soaking area formed in a final zone. When a heating treatment in the heating furnace 11 completely ends, the slab S is transported to the outside of the heating furnace 11, and moved into a rolling process by the roughing mill 12.

The roughing mill 12 passes the transported slab S through gaps between columnar rotary rolls provided across a plurality of stands. For example, the roughing mill 12 hot-rolls the slab S only using work rolls 12*a* provided at the top and bottom of a first stand so as to form a rough bar. Next, the rough bar which has passed through the work rolls 12*a* is further continuously rolled using a plurality of fourfold mills 12*b* constituted by a work roll and a back-up roll. As a result, when the rough rolling process ends, the rough bar is rolled into a thickness of approximately 30 mm to 60 mm, and transported to the finishing mill 13.

The finishing mill 13 finishing-rolls the rough bar transported from the roughing mill 12 until the thickness becomes approximately several millimeters. The finishing mill 13 passes the rough bar through gaps between top and bottom finish rolling rolls 13*a* linearly arranged across 6 to 7 stands so as to gradually reduce the rough bar. The hot-rolled steel sheet H finishing-rolled using the finishing mill 13 is transported to the cooling apparatus 14 using the transportation rolls 32 described below.

Figure 2:
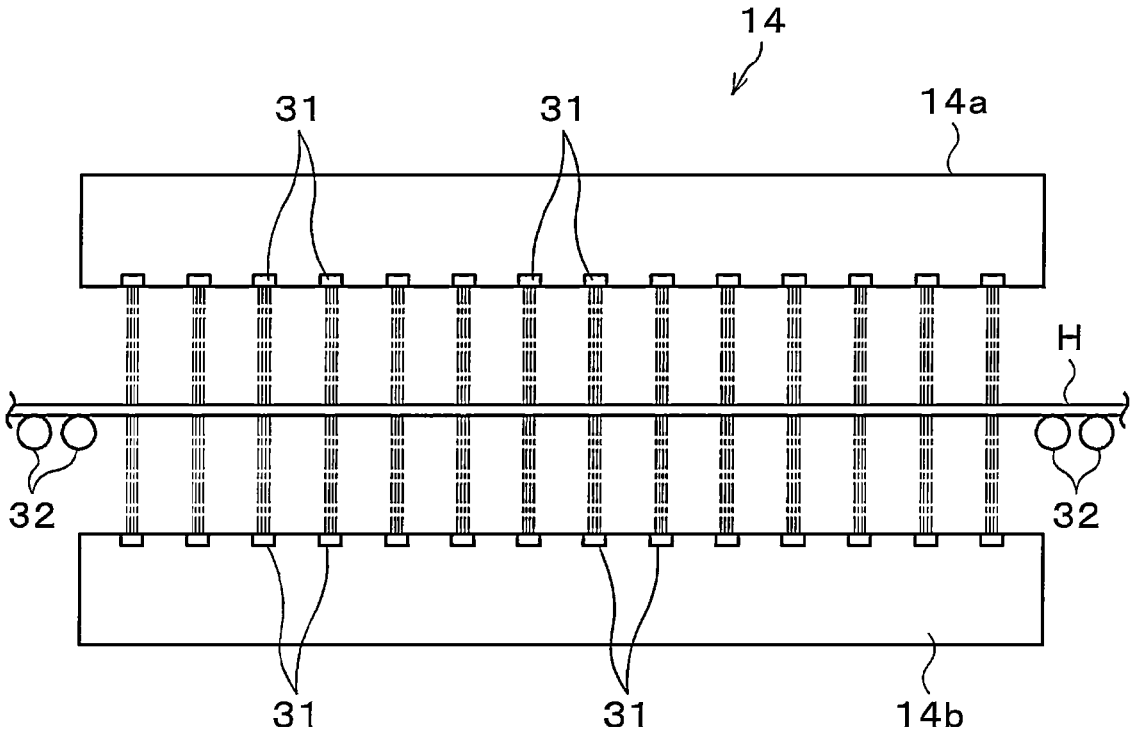
FIG. 2 is an explanatory view illustrating an outline of a configuration of a cooling apparatus 14 provided in the hot rolling facility 1.

The cooling apparatus 14 is a facility for carrying out so-called laminar cooling on the hot-rolled steel sheet H transported from the finishing mill 13. As illustrated in FIG. 2, the cooling apparatus 14 has a top side cooling apparatus 14*a* that sprays cooling water from cooling holes 31 on the top side to the top surface of the hot-rolled steel sheet H moving on the transportation rolls 32 in a run-out table, and a bottom side cooling apparatus 14*b* that sprays cooling water from cooling holes 31 on the bottom side to the bottom surface of the hot-rolled steel sheet H. A plurality of the cooling holes 31 is provided in the top side cooling apparatus 14*a* and the bottom side cooling apparatus 14*b* respectively.

In addition, a cooling header (not illustrated) is connected to the cooling hole 31. The number of the cooling holes 31 determines the cooling capabilities of the top side cooling apparatus 14*a* and the bottom side cooling apparatus 14*b*. Meanwhile, the cooling apparatus 14 may be constituted by at least one of a top and bottom split laminar, a pipe laminar, spray cooling and the like. In addition, a section in which the hot-rolled steel sheet H is cooled using the cooling apparatus 14 corresponds to a cooling section in the present invention.

The coiling apparatus 15 coils the hot-rolled steel sheet H cooled using the cooling apparatus 14 at a predetermined coiling temperature as illustrated in FIG. 1. The hot-rolled steel sheet H coiled into a coil shape using the coiling apparatus 15 is transported to the outside of the hot rolling facility 1.

Next, the method for cooling a hot-rolled steel sheet of the present embodiment, which is realized using the hot rolling facility 1 constituted as described above, will be described.

Figure 17:
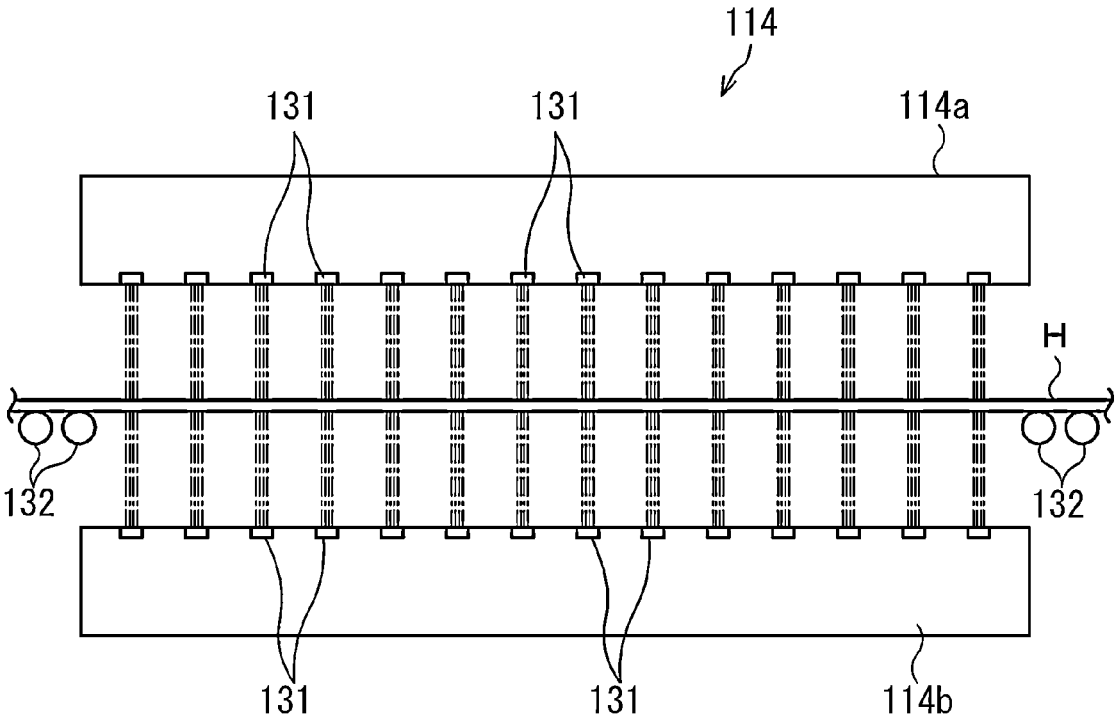
FIG. 17 is an explanatory view illustrating an outline of a configuration of a cooling apparatus 114 provided in the hot rolling facility 2.

Meanwhile, in the following description, a wave shape having a surface height (wave height) changing in the rolling direction is formed in the hot-rolled steel sheet H hot-rolled using the finishing mill 13 as illustrated in FIG. 17. In addition, in the following description, the influence of soaked water remaining on the hot-rolled steel sheet H will be ignored when cooling the hot-rolled steel sheet H. Actually, as a result of investigation by the inventors, it was found that the soaked water remaining on the hot-rolled steel sheet H has little influence.

The method for cooling a hot-rolled steel sheet of the present embodiment has two processes of a target ratio-setting process and a cooling control process.

The details will be described below, and, in the target ratio-setting process, a top and bottom heat transfer coefficient ratio X1, at which a temperature standard deviation Y becomes a minimum value Ymin, is set as a target ratio Xt based on correlation data indicating a correlation between a top and bottom heat transfer coefficient ratio X, which is a ratio of heat transfer coefficients of the top and bottom surfaces of the hot-rolled steel sheet H, and the temperature standard deviation Y during or after cooling of the hot-rolled steel sheet H, which have been experimentally obtained in advance under conditions in which the steepness and the sheet-threading speed of the hot-rolled steel sheet H are set to constant values.

In addition, in the cooling control process, at least one of an amount of heat dissipated from the top surface by cooling and an amount of heat dissipated from the bottom surface by cooling of the hot-rolled steel sheet H in the cooling section is controlled so that the top and bottom heat transfer coefficient ratio X of the hot-rolled steel sheet H in the cooling section (a section in which the hot-rolled steel sheet H is cooled using the cooling apparatus 14) matches the target ratio Xt.

The correlation data used in the target ratio-setting process is experimentally obtained in advance using the hot rolling facility 1 before actual operation (before the hot-rolled steel sheet H is actually manufactured as a product). Hereinafter, a method for obtaining the correlation data used in the target ratio-setting process will be described in detail.

First, before cooling the hot-rolled steel sheet H in the cooling apparatus 14, the cooling capability (top side cooling capability) of the top side cooling apparatus 14*a* and the cooling capability (bottom side cooling capability) of the bottom side cooling apparatus 14*b* of the cooling apparatus 14 are adjusted respectively in advance. The top side cooling capability and the bottom side cooling capability are adjusted using the heat transfer coefficient of the top surface of the hot-rolled steel sheet H, which is cooled using the top side cooling apparatus 14*a*, and the heat transfer coefficient of the bottom surface of the hot-rolled steel sheet H, which is cooled using the bottom side cooling apparatus 14*b*.

Here, a method for computing the heat transfer coefficients of the top surface and bottom surface of the hot-rolled steel sheet H will be described. The heat transfer coefficient refers to a value obtained by dividing the amount of heat dissipated from unit area by cooling (heat energy) per unit time by the temperature difference between an article to which heat is transferred and a heat medium (heat transfer coefficient=amount of heat dissipated by cooling/temperature difference). The temperature difference herein refers to the difference between the temperature of the hot-rolled steel sheet H, which is measured using a thermometer on an entry side of the cooling apparatus 14, and the temperature of cooling water used in the cooling apparatus 14.

In addition, the amount of heat dissipated by cooling refers to a value obtained by respectively multiplying the temperature difference, specific heat and mass of the hot-rolled steel sheet H (amount of heat dissipated by cooling=temperature difference×specific heat×mass). That is, the amount of heat dissipated by cooling is an amount of heat dissipated by cooling of the hot-rolled steel sheet H in the cooling apparatus 14, and a value obtained by multiplying the difference between the temperatures of the hot-rolled steel sheet H respectively measured using the entry-side thermometer and an exit-side thermometer in the cooling apparatus 14, the specific heat of the hot-rolled steel sheet H and the mass of the hot-rolled steel sheet H cooled using the cooling apparatus 14 respectively.

As described above, the computed heat transfer coefficient of the hot-rolled steel sheet H is classified into the heat transfer coefficient of the top surface and the heat transfer coefficient of the bottom surface of the hot-rolled steel sheet H. The heat transfer coefficients of the top surface and the bottom surface are computed using a ratio that is obtained in advance, for example, in the following manner.

That is, the heat transfer coefficient of the hot-rolled steel sheet H in a case in which the hot-rolled steel sheet H is cooled only using the top side cooling apparatus 14*a* and the heat transfer coefficient of the hot-rolled steel sheet H in a case in which the hot-rolled steel sheet H is cooled only using the bottom side cooling apparatus 14*b* are measured.

At this time, the amount of cooling water from the top side cooling apparatus 14*a* and the amount of cooling water from the bottom side cooling apparatus 14*b* are set to be equal. The inverse number of the ratio between the measured heat transfer coefficient in a case in which the top side cooling apparatus 14*a* is used and the heat transfer coefficient in a case in which the bottom side cooling apparatus 14*b* is used becomes a top and bottom ratio of the amount of cooling water of the top side cooling apparatus 14*a* and the amount of cooling water of the bottom side cooling apparatus 14*b* in a case in which a top and bottom heat transfer coefficient ratio X, which will be described below, is set to "1".

In addition, the above-mentioned ratio of the heat transfer coefficients of the top surface and the bottom surface of the hot-rolled steel sheet H (top and bottom heat transfer coefficient ratio X) is computed by multiplying the amount of cooling water of the top side cooling apparatus 14*a* or the amount of cooling water of the bottom side cooling apparatus 14*b* when cooling the hot-rolled steel sheet H by the top and bottom ratio of the amounts of cooling water obtained in the above manner.

In addition, in the above description, the heat transfer coefficients of the hot-rolled steel sheet H cooled only using the top side cooling apparatus 14*a* and only using the bottom side cooling apparatus 14*b* are used, but the heat transfer coefficient of the hot-rolled steel sheet H cooled using both the top side cooling apparatus 14*a* and the bottom side cooling apparatus 14*b* may be used. That is, the heat transfer coefficients of the hot-rolled steel sheet H in a case in which the amounts of cooling water of the top side cooling apparatus 14*a* and the bottom side cooling apparatus 14*b* are changed are measured, and the ratio of the heat transfer coefficients of the top surface and the bottom surface of the hot-rolled steel sheet H may be computed using the ratio of the heat transfer coefficients.

As described above, the heat transfer coefficients of the hot-rolled steel sheet H are computed, and the heat transfer coefficients of the top surface and the bottom surface of the hot-rolled steel sheet H are computed based on the above ratio of the heat transfer coefficients of the top surface and the bottom surface of the hot-rolled steel sheet H (top and bottom heat transfer coefficient ratio X).

Figure 3:
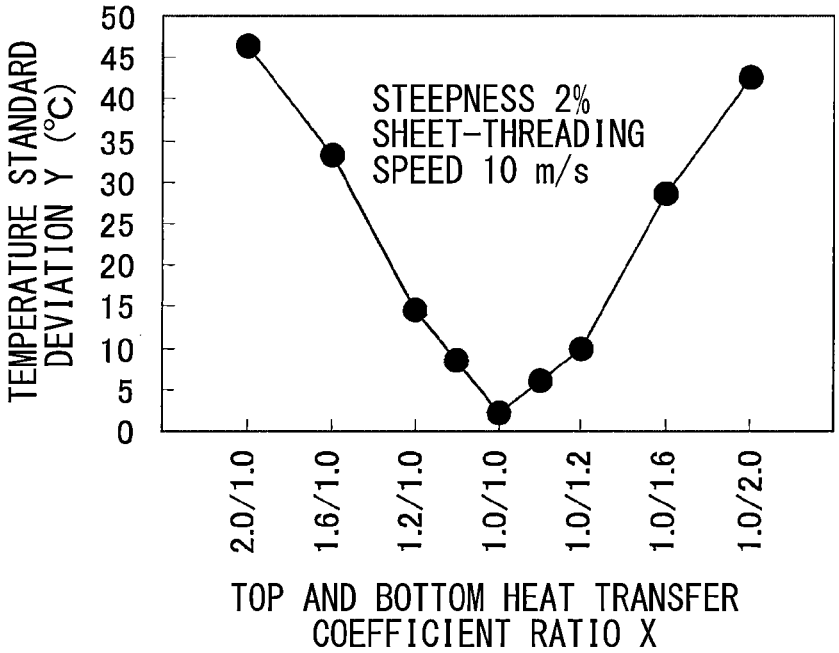
FIG. 3 is a graph illustrating a correlation between a top and bottom heat transfer coefficient ratio X and a temperature standard deviation Y which have been obtained under conditions in which steepness and sheet-threading speed of a hot-rolled steel sheet H are set to constant values.

In addition, the cooling capabilities of the top side cooling apparatus 14*a* and the bottom side cooling apparatus 14*b* are adjusted respectively using the top and bottom heat transfer coefficient ratio X of the hot-rolled steel sheet H based on FIG. 3. The horizontal axis of FIG. 3 indicates a ratio of an average heat transfer coefficient of the top surface to an average heat transfer coefficient of the bottom surface of the hot-rolled steel sheet H (that is, equivalent to the top and bottom heat transfer coefficient ratio X), and the vertical axis indicates a standard deviation of temperature between the maximum temperature and the minimum temperature of the hot-rolled steel sheet H in the rolling direction (temperature standard deviation Y).

In addition, FIG. 3 shows data (correlation data) indicating the correlation between the top and bottom heat transfer coefficient ratio X and the temperature standard deviation Y which are obtained by actually measuring the temperature standard deviation Y of the cooled hot-rolled steel sheet H while changing the top and bottom heat transfer coefficient ratio X of the hot-rolled steel sheet H by adjusting the cooling capabilities of the top side cooling apparatus 14*a* and the bottom side cooling apparatus 14*b* under conditions in which the steepness of the wave shape of the hot-rolled steel sheet H and the sheet-threading speed of the hot-rolled steel sheet H are set to constant values.

With reference to FIG. 3, it was found that the correlation between the temperature standard deviation Y and the top and bottom heat transfer coefficient ratio X becomes a V-shaped relationship in which the temperature standard deviation Y becomes the minimum value Ymin when the top and bottom heat transfer coefficient ratio X is "1".

Meanwhile, the steepness of the wave shape of the hot-rolled steel sheet H refers to a value obtained by dividing the amplitude of the wave shape by the length of a cycle in the rolling direction. FIG. 3 is correlation data between the top and bottom heat transfer coefficient ratio X and the temperature standard deviation Y which are obtained under conditions in which the steepness of the hot-rolled steel sheet H is set to 2% and the sheet-threading speed is set to 600 m/min (10 m/sec). The temperature standard deviation Y may be measured during the cooling of the hot-rolled steel sheet H, or may be measured after the cooling. In addition, in FIG. 3, the target cooling temperature of the hot-rolled steel sheet H is a temperature of 600° C. or higher, for example, 800° C.

In the target ratio-setting process, the top and bottom heat transfer coefficient ratio X1, at which the temperature standard deviation Y becomes the minimum value Ymin, is set as the target ratio Xt based on the correlation data experimentally obtained in advance as described above. The correlation data may be prepared in a form of data (table data) that indicate the correlation between the top and bottom heat transfer coefficient ratio X and the temperature standard deviation Y using a table (table form), or may be prepared in a form of data that indicate the correlation between the top and bottom heat transfer coefficient ratio X and the temperature standard deviation Y using a mathematical formula (for example, regression formula).

For example, in a case in which the correlation data are prepared in a form of data indicating the correlation between the top and bottom heat transfer coefficient ratio X and the temperature standard deviation Y using a regression formula, since the V-shaped line illustrated in FIG. 3 is drawn to be almost linear on both sides of the bottom portion, the regression formula may be derived by linearly regressing the line. When the data is considered to be a linear distribution, the number of times of confirmation using test materials or the number of times of correction for estimating calculation can be small.

Therefore, the minimum value Ymin of the temperature standard deviation Y is searched using a variety of methods, for example, a binary method, a golden section method and random search which are generally known search algorithms. The top and bottom heat transfer coefficient ratio X1 at which the temperature standard deviation Y of the hot-rolled steel sheet H becomes the minimum value Ymin is derived in the above manner based on the correlation data illustrated in FIG. 3. In addition, here, the regression formulae of the temperature standard deviations Y of the hot-rolled steel sheet H in the rolling direction with respect to the top and bottom heat transfer coefficient ratio X may be obtained respectively on both sides of an equal point above and below the average heat transfer coefficient.

Here, a method for searching the minimum value Ymin of the temperature standard deviation Y of the hot-rolled steel sheet H using the above-described binary method will be described.

Figure 4:
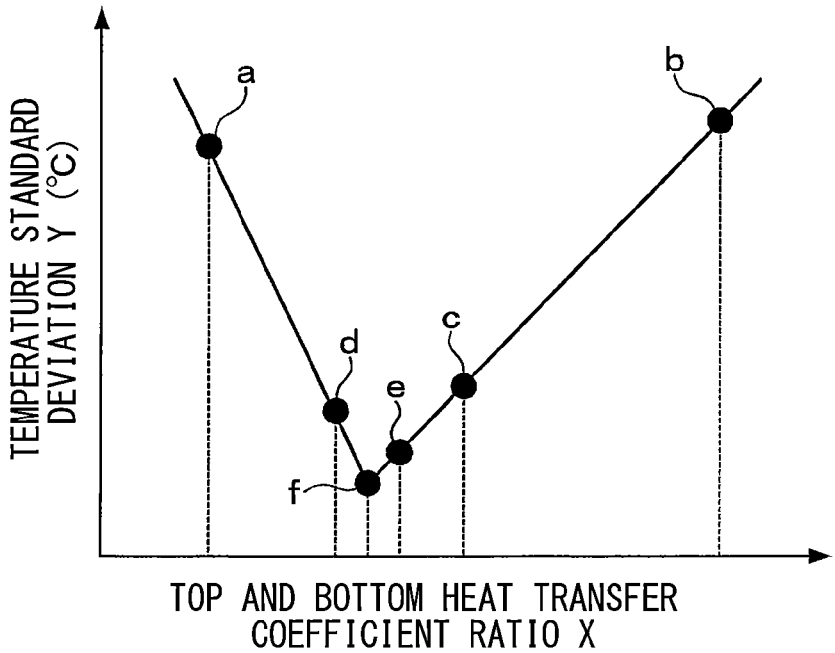
FIG. 4 is an explanatory view illustrating a method for searching a minimum point (minimum value Ymin) of the temperature standard deviation Y from the correlation illustrated in FIG. 3.

FIG. 4 illustrates a standard case in which mutually different regression lines are obtained on both sides of the minimum value Ymin of the temperature standard deviation Y. As illustrated in FIG. 4, first, temperature standard deviations Ya, Yb and Yc actually measured at a point, b point and c point which is in the center between the a point and the b point are extracted respectively. Meanwhile, the center between the a point and the b point indicates the c point at which a value between the top and bottom heat transfer coefficient ratio Xa at the a point and the top and bottom heat transfer coefficient ratio Xb at the b point is present, and this shall apply below. In addition, to which of Ya and Yb is the temperature standard deviation Yc closer is determined. In the embodiment, Yc is closer to Ya.

Next, a temperature standard deviation Yd at a d point between the a point and the c point is extracted. In addition, to which of Ya and Yc is the temperature standard deviation Yd closer is determined. In the embodiment, Yd is closer to Yc.

Next, a temperature standard deviation Ye at an e point between the c point and the d point is extracted. In addition, to which of Yc and Yd is the temperature standard deviation Ye closer is determined. In the embodiment, Ye is closer to Yd.

The above computation is repeated, and a minimum point f (minimum value Ymin) of the temperature standard deviation Y of the hot-rolled steel sheet H is specified. Meanwhile, in order to specify the practical minimum point f, the above computation needs to be carried out, for example, five times. In addition, the minimum point f may be specified by dividing the range of the top and bottom heat transfer coefficient ratio X of a search target into 10 sections, and carrying out the above computation in each of the sections.

In addition, the top and bottom heat transfer coefficient ratio X may be corrected using the so-called Newton's method. In this case, a partial difference between the top and bottom heat transfer coefficient ratio X with respect to the actual value of the temperature standard deviation Y and the top and bottom heat transfer coefficient ratio X at which the temperature standard deviation Y becomes zero is obtained using the above-described regression formula, and the top and bottom heat transfer coefficient ratio X when cooling the hot-rolled steel sheet H may be amended using the partial difference.

The top and bottom heat transfer coefficient ratio X1 at which the temperature standard deviation Y of the hot-rolled steel sheet H becomes the minimum value Ymin (Xf in FIG. 4) is derived as described above. In addition, for the relationship between the temperature standard deviation Y and the top and bottom heat transfer coefficient ratio X, which forms a V shape, it is easy to divide the graph into two sides, and obtain regression functions respectively using the method of least squares.

In addition, when FIG. 3 is referenced, the top and bottom heat transfer coefficient ratio X1 at which the temperature standard deviation Y of the hot-rolled steel sheet H becomes the minimum value Ymin is "1". Therefore, in a case in which the correlation data as illustrated in FIG. 3 is obtained, the target ratio Xt is set to "1" in the target ratio-setting process during an actual operation in order to minimize the temperature standard deviation Y, that is, in order to uniformly cool the hot-rolled steel sheet H.

In addition, in the cooling control process, at least one of the amount of heat dissipated from the top surface by cooling and the amount of heat dissipated from the bottom surface by cooling of the hot-rolled steel sheet H in the cooling section is controlled so that the top and bottom heat transfer coefficient ratio X of the hot-rolled steel sheet H in the cooling section matches the target ratio Xt (that is "1").

Specifically, in order to match the top and bottom heat transfer coefficient ratio X of the hot-rolled steel sheet H in the cooling section to the target ratio Xt (that is "1"), the amount of heat dissipated from the top surface by cooling and the amount of heat dissipated from the bottom surface by cooling of the hot-rolled steel sheet H may be equaled by, for example, adjusting the cooling capability of the top side cooling apparatus 14*a* and the cooling capability of the bottom side cooling apparatus 14*b* to be equal.

Table 1 describes the correlation data illustrated in FIG. 3 (that is, the correlation between the top and bottom heat transfer coefficient ratio X and the temperature standard deviation Y), values obtained by subtracting the respective temperature standard deviations Y by the minimum value Ymin (=2.3° C.) (the differences of the standard deviations from the minimum value), and the evaluation of the respective temperature standard deviations Y.

In the top and bottom heat transfer coefficient ratio X in Table 1, the numerator is the heat transfer coefficient of the hot-rolled steel sheet H on the top surface, and the denominator is the heat transfer coefficient of the hot-rolled steel sheet H on the bottom surface. In addition, in the evaluation in Table 1 (the evaluation of the conditions of the top and bottom heat transfer coefficient ratio X), the condition under which the temperature standard deviation Y becomes the minimum value Ymin is considered as "A", the condition under which the difference of the standard deviation from the minimum value becomes 10° C. or less, that is, the operation becomes preferable as described below is considered as "B", and the condition under which the computation is heuristically carried out in order to obtain the above-described regression formula is considered as"C". In addition, when Table 1 is referenced, the top and bottom heat transfer coefficient ratio X1 at which the evaluation becomes "A", that is, the temperature standard deviation Y of the hot-rolled steel sheet H becomes the minimum value Ymin is "1".

TABLE 1

| Top and bottom heat transfer coefficient ratio X | Temperature standard deviation Y (° C.) | Difference of standard deviation from minimum value (° C.) | Evaluation |
|---|---|---|---|
| 1.6/1.0 | 33.2 | 30.9 | C |
| 1.2/1.0 | 14.6 | 12.3 | C |
| 1.1/1.0 | 8.5 | 6.2 | B |
| 1.0/1.0 | 2.3 | 0.0 | A |
| 1.0/1.1 | 6.1 | 3.8 | B |
| 1.0/1.2 | 9.8 | 7.5 | B |
| 1.0/1.6 | 28.7 | 26.4 | C |

Meanwhile, when the temperature standard deviation Y of the hot-rolled steel sheet H converges at least in a range of the minimum value Ymin to the minimum value Ymin+10° C., it can be said that the variations in yield stress, tensile strength and the like are suppressed within the manufacturing permissible ranges, and the hot-rolled steel sheet H can be uniformly cooled. That is, in the target ratio-setting process, the top and bottom heat transfer ratio X at which the temperature standard deviation Y converges in a range of the minimum value Ymin to the minimum value Ymin+10° C. may be set as the target ratio Xt based on the correlation data experimentally obtained in advance.

Meanwhile, since there is a variety of noise in the temperature measurement of the hot-rolled steel sheet H, there are cases in which the minimum value Ymin of the temperature standard deviation Y of the hot-rolled steel sheet H is not strictly zero. Therefore, the manufacturing permissible range is set to a range in which the temperature standard deviation Y of the hot-rolled steel sheet H is the minimum value Ymin to the minimum value Ymin+10° C. in order to remove the influence of the noise.

In order to converge the temperature standard deviation Y in a range of the minimum value Ymin to the minimum value Ymin+10° C., in FIG. 3 or 4, it is necessary to pull the straight line in the horizontal axis direction from a point in the vertical axis at which the temperature standard deviation Y becomes the minimum value Ymin+10° C., obtain two intersections between the straight line and two regression lines on both sides of the V-shaped curve, and set the target ratio Xt from the top and bottom heat transfer coefficient ratio X between the two intersections. Meanwhile, in Table 1, the temperature standard deviation Y can be converged in a range of the minimum value Ymin to the minimum value Ymin+10° C. by setting the top and bottom heat transfer coefficient ratio X with an evaluation of "B" as the target ratio Xt.

In addition, in order to match the top and bottom heat transfer coefficient ratio X to the target ratio Xt, it is easiest to operate the sprayed cooling water density of at least one of the top side cooling apparatus 14*a* and the bottom side cooling apparatus 14*b*. Therefore, for example, in FIGS. 3 and 4, the values in the horizontal axis are replaced by the top and bottom sprayed water density ratio, and the regression formula of the temperature standard deviation Y of the hot-rolled steel sheet H with respect to the top and bottom ratio of the sprayed water density may be obtained on both sides of an equal point above and below the average heat transfer coefficient. Here, the equal point above and below the average heat transfer coefficient does not necessarily become an equal point above and below the sprayed cooling water density, and therefore the regression formula may be obtained by carrying out tests slightly widely.

In addition, during an actual operation, there is a possibility that the value of at least one of the steepness and the sheet-threading speed may change due to a change in the manufacturing conditions. When at least one of the steepness and the sheet-threading speed is changed, the correlation between the top and bottom heat transfer coefficient ratio X and the temperature standard deviation Y changes. Therefore, the correlation data are prepared for each of a plurality of conditions having different values of the steepness and the sheet-threading speed, and, in the target ratio-setting process, the target ratio Xt may be set based on a correlation data in accordance with actually measured values of the steepness and the sheet-threading speed during the actual operation of the plurality of correlation data. Thereby, it becomes possible to carry out uniform cooling suitable for the manufacturing conditions during the actual operation.

Here, as a result of thorough studies regarding the adjustment of the cooling capabilities of the top side cooling apparatus 14*a* and the bottom side cooling apparatus 14*b* (control of the amount of heat dissipated from the top surface by cooling and the amount of heat dissipated from the bottom surface by cooling of the hot-rolled steel sheet H) in order to uniformly cool the hot-rolled steel sheet H, the inventors further obtained the following findings.

As a result of repeating thorough studies regarding the characteristics of the temperature standard deviation Y generated by cooling in a state in which a wave shape of the hot-rolled steel sheet H is generated, the inventors clarified the following fact.

Generally, during an actual operation, it is necessary to maintain the quality of the hot-rolled steel sheet H by controlling the temperature of the hot-rolled steel sheet H at a predetermined target temperature (a temperature suitable for coiling) when coiling the hot-rolled steel sheet H using the coiling apparatus 15.

Therefore, a temperature-measuring process in which the temperature of the hot-rolled steel sheet H on the downstream side of the cooling section (that is, the cooling apparatus 14) is measured in chronological order, an average temperature value-computing process in which a chronological average value of the temperature is computed based on the measurement result of the temperature so that the chronological average value of the temperature matches a predetermined target temperature, and an amount of heat dissipated by cooling-adjusting process in which the total value of the amount of heat dissipated from the top surface by cooling and the amount of heat dissipated from the bottom surface by cooling of the hot-rolled steel sheet H in the cooling section is adjusted may be newly added to the above-described target ratio-setting process and cooling control process.

Figure 13:
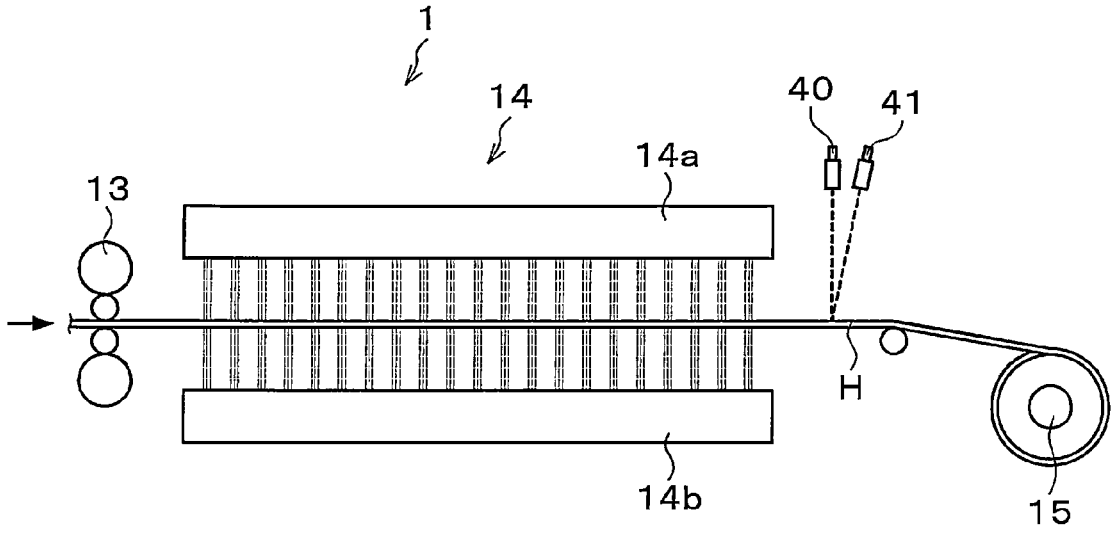
FIG. 13 is an explanatory view illustrating the details of a periphery of the cooling apparatus 14 in the hot rolling facility 1.

In order to realize the new processes, a thermometer 40 which is disposed between the cooling apparatus 14 and the coiling apparatus 15 as illustrated in FIG. 13 and measures the temperature of the hot-rolled steel sheet H can be used.

In the temperature-measuring process, with respect to the hot-rolled steel sheet H transported from the cooling apparatus 14 to the coiling apparatus 15, the temperatures at locations set in the rolling direction of the hot-rolled steel sheet H are measured at certain time intervals (sampling intervals) using the thermometer 40, and chronological data of the temperature measurement results are obtained. Meanwhile, the temperature measurement area using the thermometer 40 includes all the area of the hot-rolled steel sheet H in the width direction. In addition, when the sheet-threading speed (transportation speed) of the hot-rolled steel sheet H is multiplied at the sampling times of the respective temperature measurement results, the locations of the hot-rolled steel sheet H in the rolling direction, at which the respective temperature measurement results have been obtained, can be computed. That is, when the sampling times of the respective temperature measurement results are multiplied by the sheet-threading speed, it becomes possible to link the chronological data of the temperature measurement results to the locations in the rolling direction.

In the average temperature value-computing process, a chronological average value of the temperature measurement results is computed using the chronological data of the temperature measurement results. Specifically, each time when a certain number of the temperature measurement results are obtained, the average value of the certain number of the temperature measurement results may be computed. In addition, in the amount of heat dissipated by cooling-adjusting process, the total value of the amount of heat dissipated from the top surface by cooling and the amount of heat dissipated from the bottom surface by cooling of the hot-rolled steel sheet H in the cooling section is adjusted so that the chronological average value of the temperature measurement results computed as described above matches a predetermined target temperature.

Here, it is necessary to adjust the total value of the amount of heat dissipated from the top surface by cooling and the amount of heat dissipated from the bottom surface by cooling while achieving a control target that matches the top and bottom heat transfer coefficient ratio X of the hot-rolled steel sheet H in the cooling section to the target ratio Xt.

Specifically, when adjusting the total value of the amount of heat dissipated from the top surface by cooling and the amount of heat dissipated from the bottom surface by cooling, the on-off control of cooling headers connected to the cooling apparatus 14 may be carried out on a theoretical value obtained in advance using an experiment theoretical formula represented by, for example, Mitsuzuka's formula based on a learned value set to correct the error with an actual operation achievement. Alternatively, the on-off of the cooling headers may be feedback-controlled or feedforward-controlled based on the temperature actually measured using the thermometer 40.

Next, the cooling control of ROT of the related art will be described using data obtained from the above-described thermometer 40 and a shape meter 41 that measures the wave shape of the hot-rolled steel sheet H which is disposed between the cooling apparatus 14 and the coiling apparatus 15 as illustrated in FIG. 13.

Meanwhile, the shape meter 41 measures the shape of the same measurement location (hereinafter this measurement location will be sometimes referred to as a fixed point) as the thermometer 40 set on the hot-rolled steel sheet H. Here, the shape refers to the steepness obtained through the line integration of the heights or changing components of pitches of the wave using the movement amount of the hot-rolled steel sheet H in the sheet-threading direction as the changing amount of the hot-rolled steel sheet H in the height direction observed in a measurement at the fixed point. In addition, at the same time, the changing amount per unit time, that is, the changing speed is also obtained. Furthermore, similarly to the temperature measurement area, the shape measurement area includes all the areas of the hot-rolled steel sheet H in the width direction. Similarly to the temperature measurement results, when the sampling times of the respective measurement results (steepness, changing speed and the like) are multiplied by the sheet-threading speed, it becomes possible to link the chronological data of the respective measurement results to the locations in the rolling direction.

Figure 5:
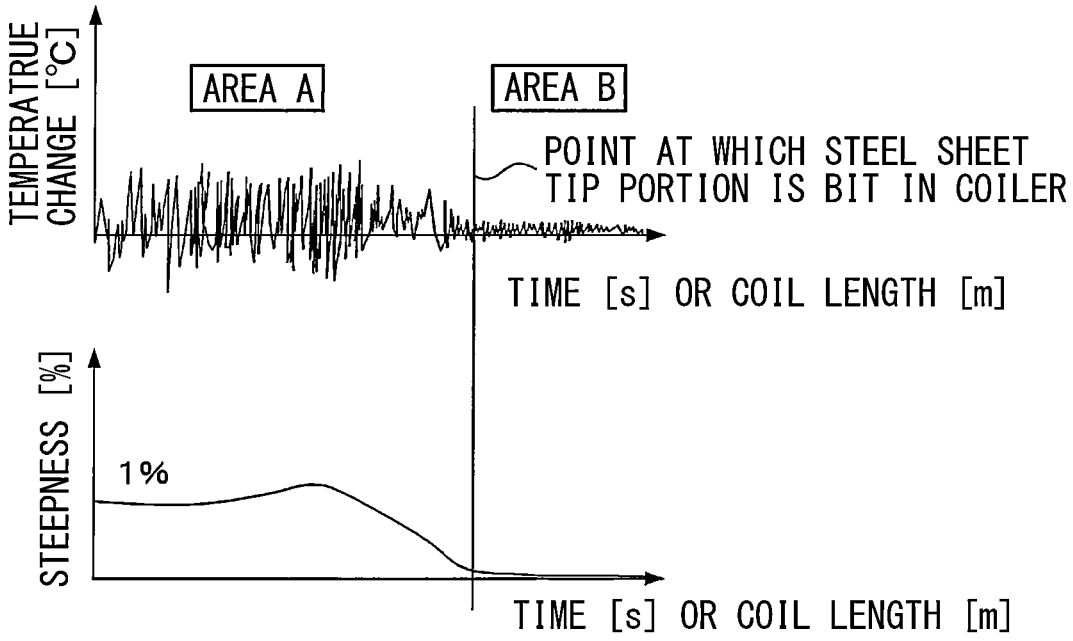
FIG. 5 is a graph illustrating a relationship between temperature change and steepness of the hot-rolled steel sheet H during cooling in ROT of a typical strip in an ordinary operation, in which the top graph indicates the temperature change with respect to a distance from a coil tip or a time at which a coil passes a fixed point, and the bottom graph indicates the steepness with respect to the distance from the coil tip or the time at which the coil passes the fixed point.

FIG. 5 illustrates the relationship between the temperature change and steepness of the hot-rolled steel sheet H during cooling in ROT of a typical strip in an ordinary operation. The top and bottom heat transfer coefficient ratio X of the hot-rolled steel sheet H in FIG. 5 is 1.2:1, and the top side cooling capability is superior to the bottom side cooling capability. The top graph in FIG. 5 indicates the temperature change with respect to the distance from a coil tip or a time at which a coil passes the fixed point, and the bottom graph in FIG. 5 indicates the steepness with respect to the distance from the coil tip or the time at which the coil passes the fixed point.

The area A in FIG. 5 is an area before the strip tip portion illustrated in FIG. 13 is bit in a coiler of the coiling apparatus 15 (since there is no tension, the shape is defective in this area). The area B in FIG. 5 is an area after the strip tip portion is bit in the coiler (the area in which the wave shape is changed to be flat by the influence of unit tension). There is a demand for improving a large temperature change (that is, the temperature standard deviation Y) occurring in the area A in which the shape of the hot-rolled steel sheet H is not flat.

Therefore, the inventors carried out thorough tests for the purpose of controlling the increase in the temperature standard deviation Y in ROT, and, consequently, obtained the following findings.

Figure 6:
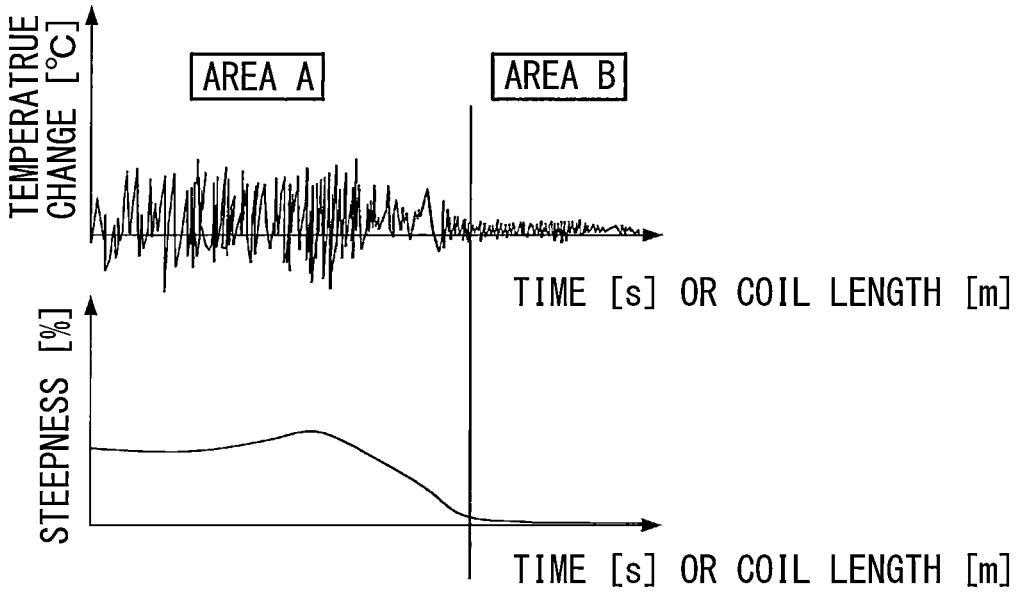
FIG. 6 is a graph illustrating the relationship between the temperature change and steepness of the hot-rolled steel sheet H during cooling in ROT of the typical strip in the ordinary operation.

Similarly to FIG. 5, FIG. 6 illustrates the temperature-changing component with respect to the steepness of the same shape during cooling in ROT of the typical strip in the ordinary operation. The temperature-changing component is a residual error obtained by subtracting the actual steel sheet temperature by the chronological average of the temperature (hereinafter sometimes referred to as "average temperature"). For example, the average temperature may be the average of the temperature of a range that is a cycle or more of the wave shape of the hot-rolled steel sheet H.

Meanwhile, the average temperature is, in principle, the average of the temperature of a range of the unit cycle. In addition, it is confirmed from operation data that there is no large difference between the average temperature of a range of a cycle and the average temperature of a range of two or more cycles.

Therefore, the average temperature simply needs to be computed from a range of at least a cycle of the wave shape. The upper limit of the range of the wave shape of the hot-rolled steel sheet H is not particularly limited; however, a sufficiently accurate average temperature can be obtained when the range is preferably set to 5 cycles. In addition, even when the average temperature is computed not from a range of the unit cycle but from a range of 2 to 5 cycles, a permissible average temperature can be obtained.

Here, when the upward side of the vertical direction (the direction that intersects the top and bottom surfaces of the hot-rolled steel sheet H) of the hot-rolled steel sheet H is set as positive, in an area with a positive changing speed measured at the fixed point, in a case in which the temperature (the temperature measured at the fixed point) of the hot-rolled steel sheet H is lower than the average temperature of a range of one or more cycles of the wave shape of the hot-rolled steel sheet H, at least one of a direction in which the amount of heat dissipated from the top surface by cooling decreases and a direction in which the amount of heat dissipated from the bottom surface by cooling increases is determined as a control direction, and, in a case in which the temperature of the hot-rolled steel sheet H is higher than the average temperature, at least one of a direction in which the amount of heat dissipated from the top surface by cooling increases and a direction in which the amount of heat dissipated from the bottom surface by cooling decreases is determined as the control direction.

In addition, in an area with a negative changing speed measured at the fixed point, in a case in which the temperature of the hot-rolled steel sheet H is lower than the average temperature, at least one of a direction in which the amount of heat dissipated from the top surface by cooling increases and a direction in which the amount of heat dissipated from the bottom surface by cooling decreases is determined as the control direction, and, in a case in which the temperature of the hot-rolled steel sheet H is higher than the average temperature, at least one of a direction in which the amount of heat dissipated from the top surface by cooling decreases and a direction in which the amount of heat dissipated from the bottom surface by cooling increases is determined as the control direction.

Figure 7:
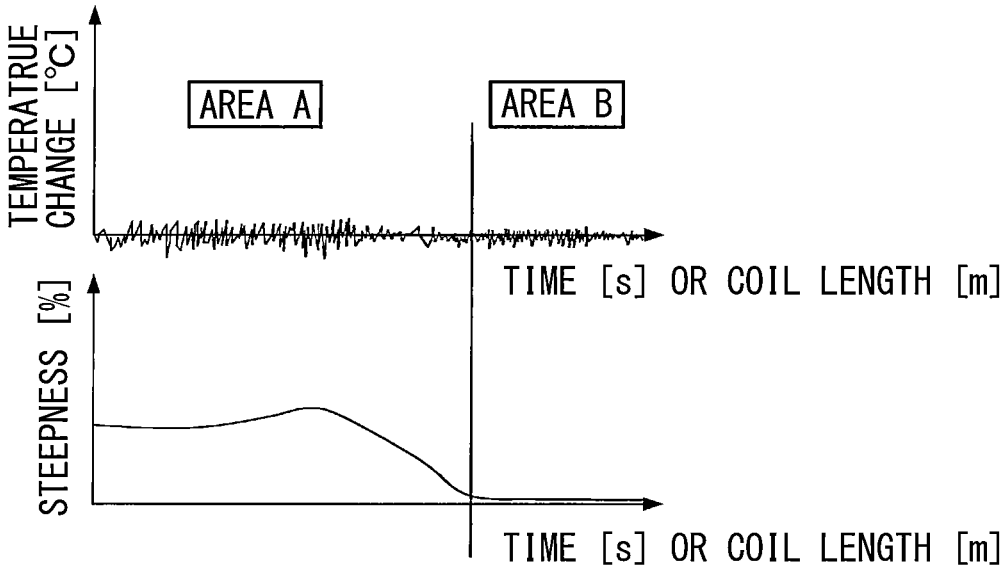
FIG. 7 is a graph illustrating the relationship between the temperature change and steepness of the hot-rolled steel sheet H when an amount of heat dissipated from the top surface by cooling is decreased and an amount of heat dissipated from the bottom surface by cooling is increased in a case in which the temperature of the hot-rolled steel sheet H becomes low with respect to an average temperature of the hot-rolled steel sheet H in an area of a positive changing speed of the hot-rolled steel sheet H and the temperature of the hot-rolled steel sheet H becomes high in an area of a negative changing speed. Meanwhile, the steepness of a wave shape of the hot-rolled steel sheet H refers to a value obtained by dividing an amplitude of the wave shape by a length of a cycle in a rolling direction.

In addition, it was found that, when at least one of the amount of heat dissipated from the top surface by cooling and the amount of heat dissipated from the bottom surface by cooling of the hot-rolled steel sheet H in the cooling section is adjusted based on the control direction determined as described above, as illustrated in FIG. 7, the temperature change occurring in the area A in which the shape of the hot-rolled steel sheet H is not flat can be reduced compared with FIG. 6.

A case in which an opposite operation to the above case is carried out will be described below. In an area with a positive changing speed measured at the fixed point, in a case in which the temperature of the hot-rolled steel sheet H is lower than the average temperature of the hot-rolled steel sheet H, at least one of a direction in which the amount of heat dissipated from the top surface by cooling increases and a direction in which the amount of heat dissipated from the bottom surface by cooling decreases is determined as the control direction, and, in a case in which the temperature of the hot-rolled steel sheet H is higher than the average temperature, at least one of a direction in which the amount of heat dissipated from the top surface by cooling decreases and a direction in which the amount of heat dissipated from the bottom surface by cooling increases is determined as the control direction.

In addition, in an area with a negative changing speed measured at the fixed point, in a case in which the temperature of the hot-rolled steel sheet H is lower than the average temperature, at least one of a direction in which the amount of heat dissipated from the top surface by cooling decreases and a direction in which the amount of heat dissipated from the bottom surface by cooling increases is determined as the control direction, and, in a case in which the temperature of the hot-rolled steel sheet H is higher than the average temperature, at least one of a direction in which the amount of heat dissipated from the top surface by cooling increases and a direction in which the amount of heat dissipated from the bottom surface by cooling decreases is determined as the control direction.

Figure 8:
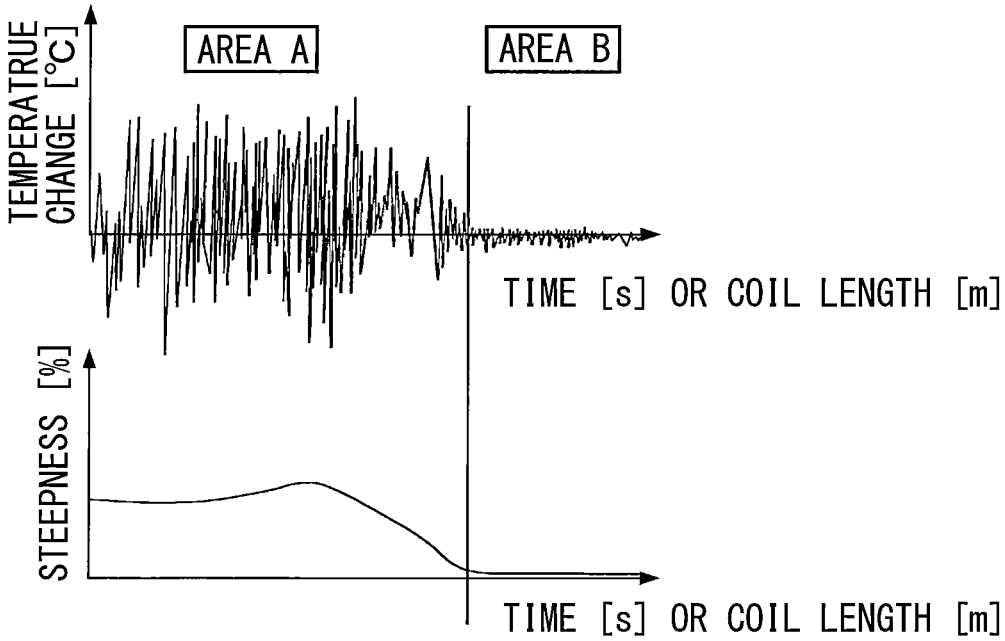
FIG. 8 is a graph illustrating the relationship between the temperature change and steepness of the hot-rolled steel sheet H when the amount of heat dissipated from the top surface by cooling is increased and the amount of heat dissipated from the bottom surface by cooling is decreased in a case in which the temperature of the hot-rolled steel sheet H becomes low with respect to the average temperature of the hot-rolled steel sheet H in the area of a positive changing speed of the hot-rolled steel sheet H and the temperature of the hot-rolled steel sheet H becomes high in the area of a negative changing speed.

In addition, it was found that, when at least one of the amount of heat dissipated from the top surface by cooling and the amount of heat dissipated from the bottom surface by cooling of the hot-rolled steel sheet H in the cooling section is adjusted based on the control direction determined as described above, as illustrated in FIG. 8, the temperature change occurring in the area A in which the shape of the hot-rolled steel sheet H is not flat enlarges compared with FIG. 6. Meanwhile, in the examples described herein, an assumption does not apply in which the cooling end temperature may be changed.

Use of the above relationship clarifies which cooling capability of the top side cooling apparatus 14*a* and the bottom side cooling apparatus 14*b* in the cooling apparatus 14 needs to be adjusted in order to reduce the temperature change, that is, the temperature standard deviation Y. Meanwhile, the above relationship is summarized in Table 2.

TABLE 2

| Changing speed | | Positive | | Negative | |
|---|---|---|---|---|---|
| Temperature | | Low | High | Low | High |
| Amount of heat dissipated by cooling | Top surface side | Decrease | Increase | Increase | Decrease |
| | Bottom surface side | Increase | Decrease | Decrease | Increase |

As such, to the target ratio-setting process and the cooling control process described above, the temperature-measuring process in which the temperature (the temperature at the fixed point) of the hot-rolled steel sheet H is measured in chronological order on the downstream side of the cooling section, a changing speed-measuring process in which the changing speed of the hot-rolled steel sheet H in the vertical direction is measured in chronological order at the same place (the fixed point) as the temperature measurement place of the hot-rolled steel sheet H, a control direction-determining process in which the control directions of the amount of heat dissipated from the top surface by cooling and the amount of heat dissipated from the bottom surface by cooling are determined based on the temperature measurement results and the changing speed measurement results, and an amount of heat dissipated by cooling-adjusting process in which at least one of the amount of heat dissipated from the top surface by cooling and the amount of heat dissipated from the bottom surface by cooling of the hot-rolled steel sheet H in the cooling section is adjusted based on the determined control directions may be newly added.

Here, in the control direction-determining process, as described above, in an area with a positive changing speed measured at the fixed point in the hot-rolled steel sheet H, in a case in which the temperature of the hot-rolled steel sheet H at the fixed point is lower than the average temperature of the hot-rolled steel sheet H at the fixed point, at least one of a direction in which the amount of heat dissipated from the top surface by cooling decreases and a direction in which the amount of heat dissipated from the bottom surface by cooling increases is determined as the control direction, and, in a case in which the temperature of the hot-rolled steel sheet H is higher than the average temperature, at least one of a direction in which the amount of heat dissipated from the top surface by cooling increases and a direction in which the amount of heat dissipated from the bottom surface by cooling decreases is determined as the control direction.

In addition, in the control direction-determining process, in an area with a negative changing speed, in a case in which the temperature of the hot-rolled steel sheet H is lower than the average temperature, at least one of a direction in which the amount of heat dissipated from the top surface by cooling increases and a direction in which the amount of heat dissipated from the bottom surface by cooling decreases is determined as the control direction, and, in a case in which the temperature of the hot-rolled steel sheet H is higher than the average temperature, at least one of a direction in which the amount of heat dissipated from the top surface by cooling decreases and a direction in which the amount of heat dissipated from the bottom surface by cooling increases is determined as the control direction.

Meanwhile, in this cooling method as well, it is necessary to adjust the amount of heat dissipated from the top surface by cooling and the amount of heat dissipated from the bottom surface by cooling while achieving a control target that matches the top and bottom heat transfer coefficient ratio X of the hot-rolled steel sheet H in the cooling section to the target ratio Xt.

Meanwhile, when adjusting the cooling capability of the top side cooling apparatus 14*a* and the cooling capability of the bottom side cooling apparatus 14*b*, for example, the cooling headers connected to cooling holes 31 in the top side cooling apparatus 14*a* and the cooling headers connected to cooling holes 31 in the bottom side cooling apparatus 14*b* may be on-off controlled respectively. Alternatively, the cooling capabilities of the respective cooling headers in the top side cooling apparatus 14*a* and the bottom side cooling apparatus 14*b* may be controlled. That is, at least one of the sprayed water density, pressure and water temperature of cooling water sprayed from the respective cooling holes 31 may be adjusted.

In addition, the flow rate or pressure of cooling water sprayed from the top side cooling apparatus 14*a* and the bottom side cooling apparatus 14*b* may be adjusted by thinning out the cooling headers (cooling holes 31) of the top side cooling apparatus 14*a* and the bottom side cooling apparatus 14*b*. For example, in a case in which the cooling capability of the top side cooling apparatus 14*a* before thinning out the cooling headers is superior to the cooling capability of the bottom side cooling apparatus 14*b*, the cooling headers that constitute the top side cooling apparatus 14*a* are preferably thinned out.

The hot-rolled steel sheet H is uniformly cooled by spraying cooling water onto the top surface of the hot-rolled steel sheet H from the top side cooling apparatus 14*a* and spraying cooling water onto the bottom surface of the hot-rolled steel sheet H from the bottom side cooling apparatus 14*b* using the cooling capabilities adjusted as described above.

In the above embodiment, a case in which the correlation data illustrated in FIG. 3 are obtained with the sheet-threading speed of the hot-rolled steel sheet H fixed to 600 m/min has been described. Furthermore, the details will be described below; however, as a result of thorough studies, the inventors found that, when the sheet-threading speed is set to 550 m/min or more, it is possible to more uniformly cool the hot-rolled steel sheet H.

It was found that, if the sheet-threading speed of the hot-rolled steel sheet H is set to 550 m/min or more, the influence of soaked water on the hot-rolled steel sheet H becomes significantly small even when cooling water is sprayed onto the hot-rolled steel sheet H. Therefore, it is possible to prevent the ununiform cooling of the hot-rolled steel sheet H due to soaked water.

In the above embodiment, the cooling of the hot-rolled steel sheet H using the cooling apparatus 14 is preferably carried out in a range of the exit-side temperature of a finishing mill to a temperature of the hot-rolled steel sheet H of 600° C. A temperature range in which the temperature of the hot-rolled steel sheet H is 600° C. or higher is a so-called film boiling area. That is, in this case, it is possible to prevent a so-called transition boiling area and to cool the hot-rolled steel sheet H in the film boiling area. In the transition boiling area, when cooling water is sprayed onto the surface of the hot-rolled steel sheet H, portions covered with a vapor film and portions in which the cooling water is directly sprayed onto the hot-rolled steel sheet H are present in a mixed state on the surface of the hot-rolled steel sheet H.

Therefore, it is not possible to uniformly cool the hot-rolled steel sheet H. On the other hand, in the film boiling area, since the hot-rolled steel sheet H is cooled in a state in which the entire surface of the hot-rolled steel sheet H is covered with a vapor film, it is possible to uniformly cool the hot-rolled steel sheet H. Therefore, it is possible to more uniformly cool the hot-rolled steel sheet H in a range in which the temperature of the hot-rolled steel sheet H is 600° C. or higher as in the present embodiment.

In the above embodiment, when adjusting the cooling capability of the top side cooling apparatus 14*a* and the cooling capability of the bottom side cooling apparatus 14*b* of the cooling apparatus 14 using the correlation data illustrated in FIG. 3, the steepness of the wave shape of the hot-rolled steel sheet H and the sheet-threading speed of the hot-rolled steel sheet H were set to be constant. However, there are also cases in which, for example, the steepness or the sheet-threading speed of the hot-rolled steel sheet H is different in each of the coils.

Figure 9:
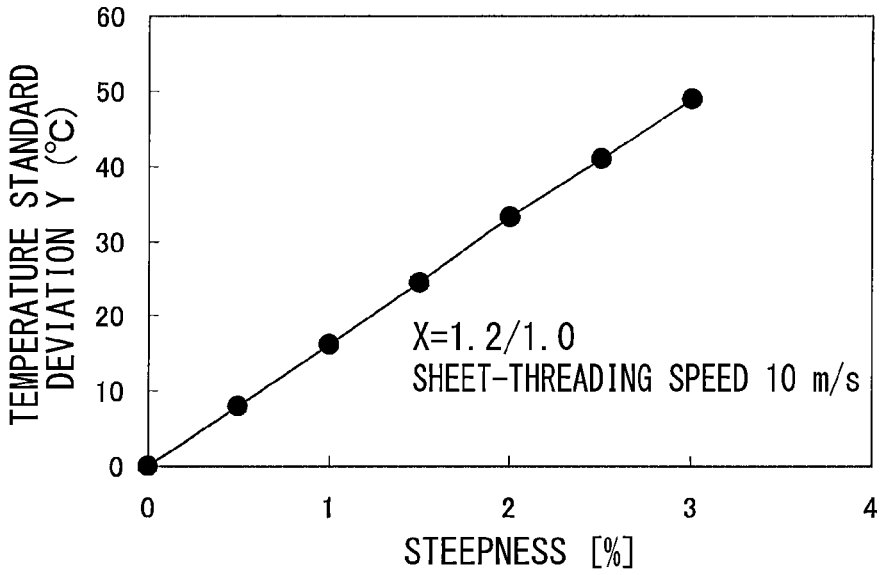
FIG. 9 is a graph illustrating the correlation between the steepness and the temperature standard deviation Y of the hot-rolled steel sheet H which have been obtained under conditions in which the top and bottom heat transfer coefficient ratio X and the sheet-threading speed are set to constant values.
Figure 10:
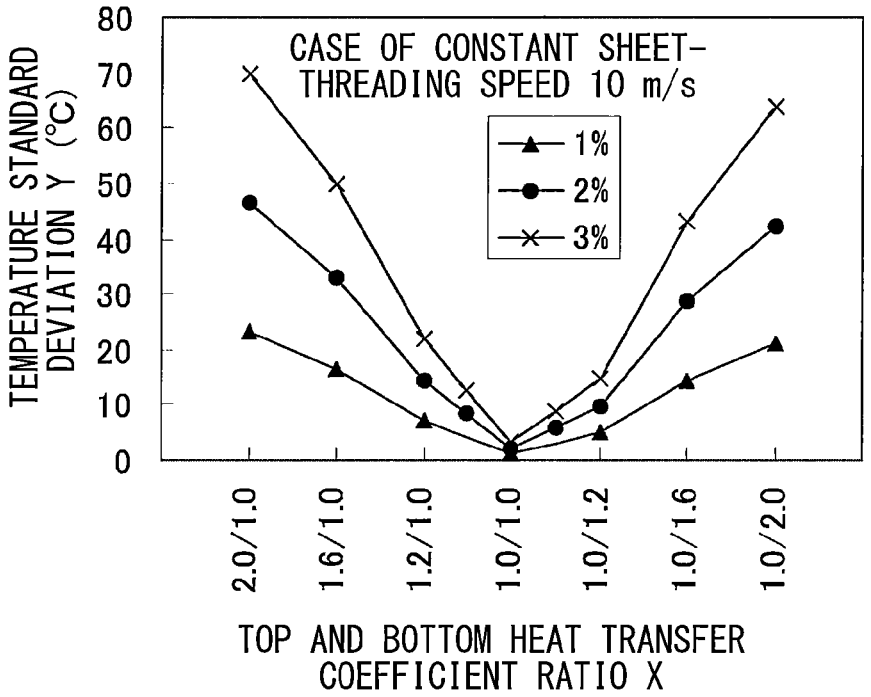
FIG. 10 is a graph illustrating the correlations between the top and bottom heat transfer coefficient ratios X and the temperature standard deviations Y which have been obtained respectively under a plurality of conditions in which the values of the steepness are different (wherein the sheet-threading speed is constant).

According to the investigation by the inventors, for example, when the steepness of the wave shape of the hot-rolled steel sheet H becomes large as illustrated in FIG. 9, the temperature standard deviation Y of the hot-rolled steel sheet H becomes large. That is, as the top and bottom heat transfer coefficient ratio X is away from "1" as illustrated in FIG. 10, the temperature standard deviation Y becomes large in accordance with the steepness (the sensitivity of the steepness). In FIG. 10, the relationship between the top and bottom heat transfer coefficient ratio X and the temperature standard deviation Y is expressed using a V-shaped regression line for each steepness as described above. Meanwhile, in FIG. 10, the sheet-threading speed of the hot-rolled steel sheet H is constant at 10 msec (600 m/min).

Figure 11:
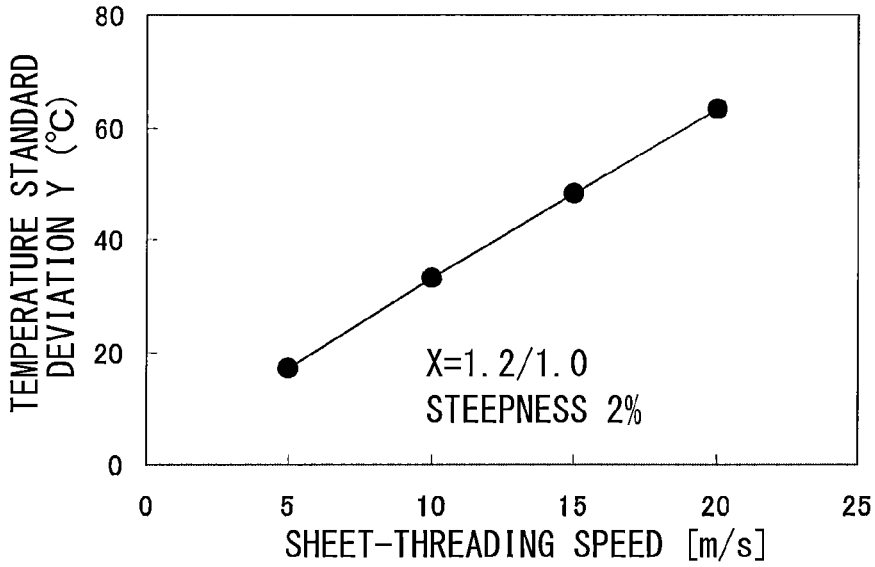
FIG. 11 is a graph illustrating the correlation between the sheet-threading speed and temperature standard deviation Y of the hot-rolled steel sheet H which have been obtained under conditions in which the top and bottom heat transfer coefficient ratio X and the steepness are set to constant values.
Figure 12:
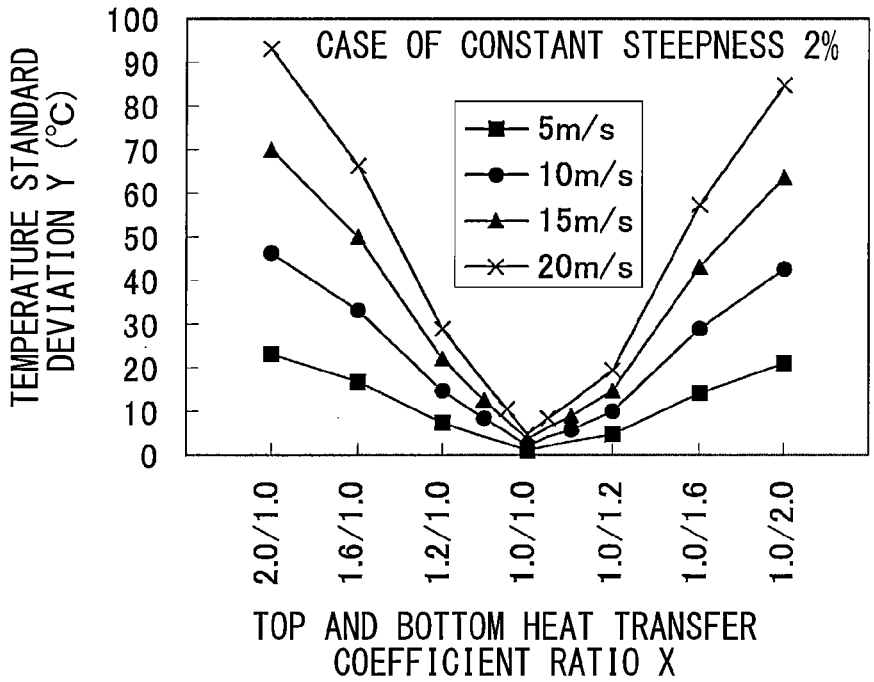
FIG. 12 is a graph illustrating the correlation between the top and bottom heat transfer coefficient ratios X and the temperature standard deviations Y which have been obtained respectively under a plurality of conditions in which the values of the sheet-threading speed are different (wherein the steepness is constant).

In addition, for example, when the sheet-threading speed of the hot-rolled steel sheet H becomes a high speed as illustrated in FIG. 11, the temperature standard deviation Y of the hot-rolled steel sheet H becomes large. That is, as the top and bottom heat transfer coefficient ratio X is away from "1" as illustrated in FIG. 12, the temperature standard deviation Y becomes large in accordance with the sheet-threading speed (the sensitivity of the sheet-threading speed). In FIG. 12, the relationship between the top and bottom heat transfer coefficient ratio X and the temperature standard deviation Y is expressed using a V-shaped regression line for each sheet-threading speed as described above. Meanwhile, in FIG. 12, the steepness of the wave shape of the hot-rolled steel sheet H is constant at 2%.

In a case in which the steepness or sheet-threading speed of the hot-rolled steel sheet H is not constant as described above, the change of the temperature standard deviation Y with respect to the top and bottom heat transfer coefficient ratio X can be qualitatively evaluated, but cannot be accurately quantitatively evaluated.

Therefore, table data indicating the correlation between each steepness and the temperature standard deviation Y of the cooled hot-rolled steel sheet H are obtained by, for example, fixing the top and bottom heat transfer coefficient ratio X of the hot-rolled steel sheet H in advance, and changing the steepness in a stepwise manner from 3% to 0% as illustrated in FIG. 9. In addition, the temperature standard deviation Y with respect to the actual steepness z % of the hot-rolled steel sheet H is corrected to the temperature standard deviation Y' with respect to a predetermined steepness using an interpolation function. Specifically, in a case in which the predetermined steepness is set to 2% as a correction condition, a temperature standard deviation Yz' is computed using the following formula (1) based on the temperature standard deviation Yz at the steepness z %. Alternatively, the temperature standard deviation Yz' may be computed by, for example, computing the gradient α of the steepness in FIG. 9 using the least squares method or the like and using the gradient α.

$$Yz' = Yz \times 2/z \quad (1)$$

In addition, in the regression formula of the V-shaped curve illustrated in FIG. 10, the steepness may be corrected to the predetermined steepness, and the temperature standard deviation Y may be derived from the regression formula. Meanwhile, Table 3 describes the temperature standard deviations Y of the hot-rolled steel sheet H in a case in which the top and bottom heat transfer coefficient ratio X is changed with respect to the steepness in FIG. 9 as illustrated in FIG. 10, values obtained by subtracting the respective temperature standard deviations Y of the hot-rolled steel sheet H by the minimum value Ymin (Ymin=1.2° C. in a case in which the steepness is 1%, Ymin=2.3° C. in a case in which the steepness is 2%, and Ymin=3.5° C. in a case in which the steepness is 3%) (the differences of the standard deviations from the minimum value), and the evaluation of the respective temperature standard deviations Y.

The indication and evaluation standards of the top and bottom heat transfer coefficient ratio X in Table 3 are the same as in the evaluation in Table 1, and thus will not be described. The temperature standard deviation Y of the hot-rolled steel sheet H in accordance with the steepness can be derived using FIG. 10 or Table 3. In addition, for example, in a case in which the steepness is corrected to 2%, it is possible to set a top and bottom heat transfer coefficient ratio X, at which the evaluation in Table 3 becomes "B", that is, the difference of the standard deviation from the minimum value of the hot-rolled steel sheet H becomes 10° C. or less, to 1.1.

TABLE 3

| Steepness (%) | Top and bottom heat transfer coefficient ratio X | Temperature standard deviation (° C.) | Difference of standard deviation from minimum value (° C.) | Evaluation |
|---|---|---|---|---|
| 1 | 1.6/1.0 | 16.6 | 15.4 | C |
| | 1.2/1.0 | 7.3 | 6.1 | B |
| | 1.0/1.0 | 1.2 | 0.0 | A |
| | 1.0/1.2 | 4.9 | 3.7 | B |
| | 1.0/1.6 | 14.4 | 13.2 | C |
| 2 | 1.6/1.0 | 33.2 | 30.9 | C |
| | 1.1/1.0 | 8.5 | 6.2 | B |
| | 1.0/1.0 | 2.3 | 0.0 | A |
| | 1.0/1.1 | 6.1 | 3.8 | B |
| | 1.0/1.6 | 28.7 | 26.4 | C |
| 3 | 1.2/1.0 | 21.9 | 18.4 | C |
| | 1.1/1.0 | 12.7 | 9.2 | B |
| | 1.0/1.0 | 3.5 | 0.0 | A |
| | 1.0/1.1 | 9.1 | 5.6 | B |
| | 1.0/1.2 | 14.7 | 11.2 | C |

Similarly, table data indicating the correlation between the respective sheet-threading speeds and the temperature standard deviation Y of the cooled hot-rolled steel sheet H are obtained by, for example, changing the sheet-threading speed in a stepwise manner from 5 m/sec (300 m/min) to 20 m/sec (1200 m/min) as illustrated in FIG. 11. In addition, the temperature standard deviation Y with respect to the actual sheet-threading speed v (m/sec) of the hot-rolled steel sheet H is corrected to the temperature standard deviation Yv' with respect to a predetermined sheet-threading speed using an interpolation function. Specifically, in a case in which the predetermined sheet-threading speed is set to 10 (m/sec) as a correction condition, a temperature standard deviation Yv' is computed using the following formula (2) based on the temperature standard deviation Yv at the sheet-threading speed v (m/sec). Alternatively, the temperature standard deviation Yv' may be computed by, for example, computing the gradient β of the sheet-threading speed in FIG. 11 using the least squares method or the like and using the gradient 13.

$$Yz' = Yv \times 10/v \quad (2)$$

In addition, in the regression formula of the V-shaped curve illustrated in FIG. 12, the sheet-threading speed may be corrected to the predetermined sheet-threading speed, and the temperature standard deviation Y may be derived from the regression formula. Meanwhile, Table 4 describes the temperature standard deviations Y of the hot-rolled steel sheet H in a case in which the top and bottom heat transfer coefficient ratio X is changed with respect to the sheet-threading speed in FIG. 11 as illustrated in FIG. 12, values obtained by subtracting the respective temperature standard deviations Y by the minimum value Ymin (Ymin=1.2° C. in a case in which the sheet-threading speed is 5 m/s, Ymin=2.3° C. in a case in which the sheet-threading speed is 10 m/s, Ymin=3.5° C. in a case in which the sheet-threading speed is 15 m/s, and Ymin=4.6° C. in a case in which the sheet-threading speed is 20 m/s) (the differences of the standard deviations from the minimum value), and the evaluation of the respective temperature standard deviations Y.

The indication and evaluation standards of the top and bottom heat transfer coefficient ratio X in Table 4 are the same as in the evaluation in Table 1, and thus will not be described. The temperature standard deviation Y of the hot-rolled steel sheet H in accordance with the sheet-threading speed can be derived using FIG. 12 or Table 4. In addition, for example, in a case in which the sheet-threading speed is corrected to 10 m/sec, it is possible to set a top and bottom heat transfer coefficient ratio X, at which the evaluation in Table 4 becomes "B", that is, the difference of the standard deviation from the minimum value of the hot-rolled steel sheet H becomes 10° C. or less, to 1.1.

TABLE 4

| Sheet-threading speed (m/s) | Top and bottom heat transfer coefficient ratio X | Temperature standard deviation Y (° C.) | Difference of standard deviation from minimum value (° C.) | Evaluation |
|---|---|---|---|---|
| 5 | 1.6/1.0 | 16.6 | 15.4 | C |
| | 1.2/1.0 | 7.3 | 6.1 | B |
| | 1.0/1.0 | 1.2 | 0.0 | A |
| | 1.0/1.2 | 4.9 | 3.7 | B |
| | 1.0/1.6 | 14.4 | 13.2 | C |
| 10 | 1.6/1.0 | 33.2 | 30.9 | C |
| | 1.1/1.0 | 8.5 | 6.2 | B |
| | 1.0/1.0 | 2.3 | 0.0 | A |
| | 1.0/1.1 | 6.1 | 3.8 | B |
| | 1.0/1.6 | 28.7 | 26.4 | C |
| 15 | 1.2/1.0 | 21.9 | 18.4 | C |
| | 1.1/1.0 | 12.7 | 9.2 | B |
| | 1.0/1.0 | 3.5 | 0.0 | A |
| | 1.0/1.1 | 9.1 | 5.6 | B |
| | 1.0/1.2 | 14.7 | 11.2 | C |
| 20 | 1.2/1.0 | 29.2 | 24.6 | C |
| | 1.05/1.0 | 10.8 | 6.2 | B |
| | 1.0/1.0 | 4.6 | 0.0 | A |
| | 1.0/1.05 | 8.4 | 3.8 | B |
| | 1.0/1.2 | 19.6 | 15.0 | C |

When the temperature standard deviation Y is corrected as described above, it is possible to accurately quantitatively evaluate the change in the temperature standard deviation Y with respect to the top and bottom heat transfer coefficient ratio even in a case in which the steepness or the sheet-threading speed of the hot-rolled steel sheet H is not constant.

In the above embodiment, the temperature and wave shape of the hot-rolled steel sheet H cooled using the cooling apparatus 14 may be measured, and the cooling capability of the top side cooling apparatus 14*a* and the cooling capability of the bottom side cooling apparatus 14*b* may be adjusted based on the measurement results. That is, the cooling capabilities of the top side cooling apparatus 14*a* and the bottom side cooling apparatus 14*b* may be feedback-controlled.

In this case, the thermometer 40 that measures the temperature of the hot-rolled steel sheet H and the shape meter 41 that measures the wave shape of the hot-rolled steel sheet H are disposed between the cooling apparatus 14 and the coiling apparatus 15 as illustrated in FIG. 13.

In addition, the temperature and shape of the hot-rolled steel sheet H in the process of sheet-threading are measured at the same point of the fixed point respectively using the thermometer 40 and the shape meter 41, and the temperature and the shape are measured as chronological data. Meanwhile, the temperature measurement area includes all the area of the hot-rolled steel sheet H in the width direction. In addition, the shape indicates the changing amount of the hot-rolled steel sheet H in the height direction observed in a measurement at the fixed point. Furthermore, similarly to the temperature measurement area, the shape measurement area includes all the area of the hot-rolled steel sheet H in the width direction. When the sampling times are multiplied by the sheet-threading speed, it becomes possible to link the chronological data of the measurement results of the temperature, changing speed and the like to the locations in the rolling direction.

As described using FIGS. 5, 6, 7 and 8, in an area with a positive changing speed at the fixed point in the hot-rolled steel sheet H, in a case in which the temperature of the hot-rolled steel sheet H at the fixed point is lower than the average temperature at the fixed point, it is possible to reduce the temperature standard deviation Y by decreasing the top side cooling capability (the amount of heat dissipated from the top surface by cooling). Similarly, it is possible to reduce the temperature standard deviation Y by increasing the bottom side cooling capability (the amount of heat dissipated from the bottom surface by cooling). Use of the above relationship clarifies which cooling capability of the top side cooling apparatus 14*a* and the bottom side cooling apparatus 14*b* in the cooling apparatus 14 needs to be adjusted in order to reduce the temperature standard deviation Y.

That is, by understanding the changing location of the temperature linked to the wave shape of the hot-rolled steel sheet H, it is possible to clarify which of the top side cooling and the bottom side cooling causes the currently occurring temperature standard deviation Y. Therefore, the increase and decrease directions (control directions) of the top side cooling capability (amount of heat dissipated from the top surface by cooling) and the bottom side cooling capability (amount of heat dissipated from the bottom surface by cooling) for decreasing the temperature standard deviation Y are determined, and it is possible to adjust the top and bottom heat transfer coefficient ratio X.

In addition, it is possible to determine the top and bottom heat transfer coefficient ratio X based on the degree of the temperature standard deviation Y so that the temperature standard deviation Y converges in a permissible range, for example, a range of the minimum value Ymin to the minimum value Ymin+10° C. Since the method for determining the top and bottom heat transfer coefficient ratio X is the same as in the above embodiment described using FIGS. 3 and 4, the method will not be described in detail. Meanwhile, when the temperature standard deviation Y is converged in a range of the minimum value Ymin to the minimum value Ymin+10° C., the variations in yield stress, tensile strength and the like are suppressed within the manufacturing permissible ranges, and the hot-rolled steel sheet H can be uniformly cooled.

In addition, although there are large variations, the temperature standard deviation Y can be converged in a range of the minimum value Ymin to the minimum value Ymin+10° C. as long as a sprayed cooling water density ratio is ±5% or less with respect to the sprayed cooling water density ratio at which the temperature standard deviation Y becomes the minimum value Ymin. That is, in a case in which the sprayed cooling water density is used, the top and bottom ratio of the sprayed cooling water density (sprayed cooling water density ratio) is desirably set to ±5% or less with respect to the sprayed cooling water density ratio at which the temperature standard deviation Y becomes the minimum value Ymin. However, the permissible range does not always include the top and bottom sprayed water density.

As described above, since the cooling capabilities of the top side cooling apparatus 14*a* and the bottom side cooling apparatus 14*b* can be adjusted to be qualitatively and quantitatively appropriate cooling capabilities through feedback control, it is possible to further improve the uniformity of the hot-rolled steel sheet H which will be cooled afterwards.

Figure 14:
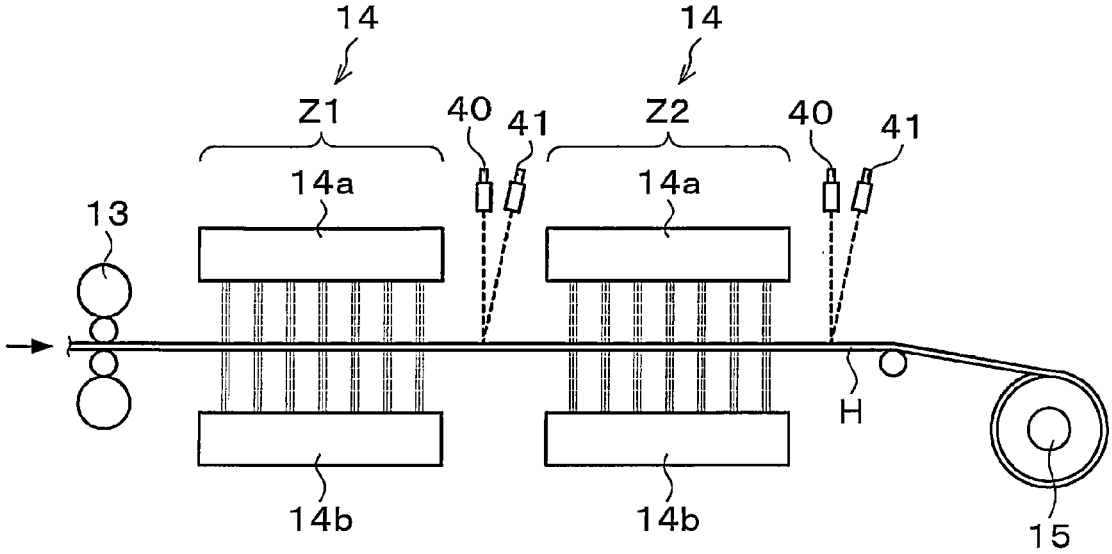
FIG. 14 is an explanatory view illustrating a modified example of the cooling apparatus 14.

In the above embodiment, the cooling section in which the hot-rolled steel sheet H is cooled may be divided into a plurality of sections, for example, two divided cooling sections Z1 and Z2 in the rolling direction as illustrated in FIG. 14. Each of the divided cooling sections Z1 and Z2 is provided with the cooling apparatus 14. In addition, the thermometer 40 and the shape meter 41 are provided respectively at the border between the respective divided cooling sections Z1 and Z2, that is, on the downstream side of the divided cooling sections Z1 and Z2. Meanwhile, in the embodiment, the cooling section is divided into two divided cooling sections, but the number of divisions is not limited thereto, and can be arbitrarily set. For example, the cooling section may be divided into 1 to 5 divided cooling sections.

In this case, the temperature and wave shape of the hot-rolled steel sheet H on the downstream side of the divided cooling sections Z1 and Z2 are respectively measured using the respective thermometers 40 and the respective shape meters 41. In addition, the cooling capabilities of the top side cooling apparatus 14*a* and the bottom side cooling apparatus 14*b* at the respective divided cooling sections Z1 and Z2 are controlled based on the measurement results. At this time, the cooling capabilities are controlled so that the temperature standard deviation Y of the hot-rolled steel sheet H is converged in the permissible range, for example, a range of the minimum value Ymin to the minimum value Ymin+10° C. as described above. At least one of the amount of heat dissipated from the top surface by cooling and the amount of heat dissipated from the bottom surface by cooling of the hot-rolled steel sheet H at the respective divided cooling sections Z1 and Z2 is adjusted in the above manner.

For example, in the divided cooling section Z1, the cooling capabilities of the top side cooling apparatus 14*a* and the bottom side cooling apparatus 14*b* are feedback-controlled based on the measurement results of the thermometer 40 and the shape meter 41 on the downstream side, thereby at least one of the amount of heat dissipated from the top surface by cooling and the amount of heat dissipated from the bottom surface by cooling is adjusted.

In addition, in the divided cooling section Z2, the cooling capabilities of the top side cooling apparatus 14*a* and the bottom side cooling apparatus 14*b* may be feedforward-controlled or feedback-controlled based on the measurement results of the thermometer 40 and the shape meter 41 on the downstream side. In any cases, in the divided cooling section Z2, at least one of the amount of heat dissipated from the top surface by cooling and the amount of heat dissipated from the bottom surface by cooling is adjusted.

Since the method for controlling the cooling capabilities of the top side cooling apparatus 14*a* and the bottom side cooling apparatus 14*b* based on the measurement results of the thermometer 40 and the shape meter 41 is the same as in the above embodiment described using FIGS. 5 to 8, the method will not be described in detail.

In this case, since at least one of the amount of heat dissipated from the top surface by cooling and the amount of heat dissipated from the bottom surface by cooling of the hot-rolled steel sheet H is adjusted in the respective divided cooling sections Z1 and Z2, finer control becomes possible. Therefore, it is possible to more uniformly cool the hot-rolled steel sheet H.

In the above embodiment, in the respective divided cooling sections Z1 and Z2, when adjusting at least one of the amount of heat dissipated from the top surface by cooling and the amount of heat dissipated from the bottom surface by cooling of the hot-rolled steel sheet H, at least one of the steepness of the wave shape and the sheet-threading speed of the hot-rolled steel sheet H may be used in addition to the measurement results of the thermometer 40 and the shape meter 41. In this case, the temperature standard deviation Y of the hot-rolled steel sheet H in accordance with at least the steepness or the sheet-threading speed is corrected using the same method as in the above embodiment described using FIGS. 9 to 12. In addition, at least one of the amount of heat dissipated from the top surface by cooling and the amount of heat dissipated from the bottom surface by cooling of the hot-rolled steel sheet H in the respective divided cooling sections Z1 and Z2 is corrected based on the corrected temperature standard deviation Y (Y'). Thereby, it is possible to more uniformly cool the hot-rolled steel sheet H.

Figure 15:
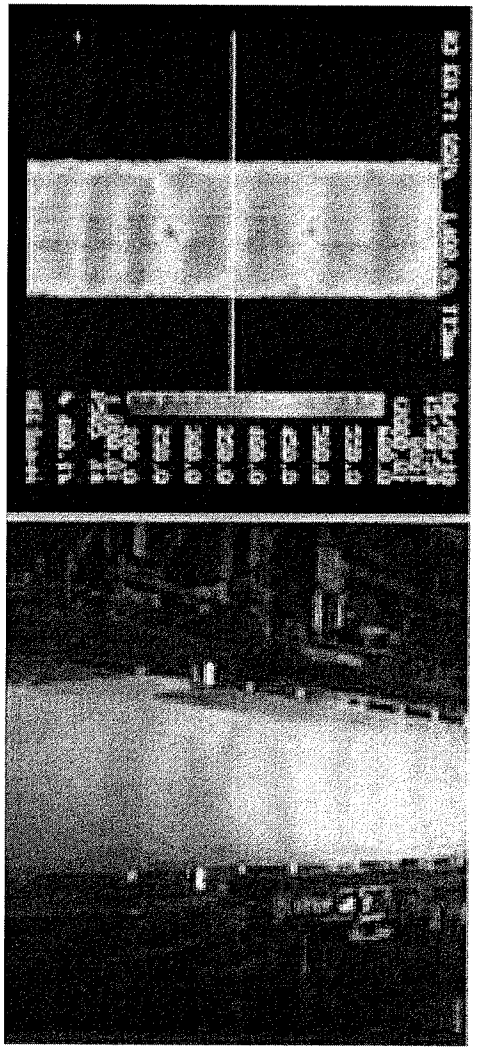
FIG. 15 is an explanatory view illustrating a shape of the temperature standard deviation of the hot-rolled steel sheet H formed in a sheet width direction.

In addition, according to the present embodiment, it becomes possible to finish the hot-rolled steel sheet H so that a uniform shape or material is formed in the sheet width direction of the hot-rolled steel sheet H as well. FIG. 15 illustrates an example of a pattern in which a wave shape having an amplitude changing in the sheet width direction of the hot-rolled steel sheet H is formed due to center buckle. As such, even in a case in which the wave shape having an amplitude changing in the sheet width direction is generated so as to form a temperature standard deviation in the sheet width direction, according to the above-described embodiment, it becomes possible to reduce the temperature standard deviation in the sheet width direction.

Hereinafter, the method for uniformly cooling the hot-rolled steel sheet H by setting the sheet-threading speed to a high speed will be described in detail.

Figure 16:
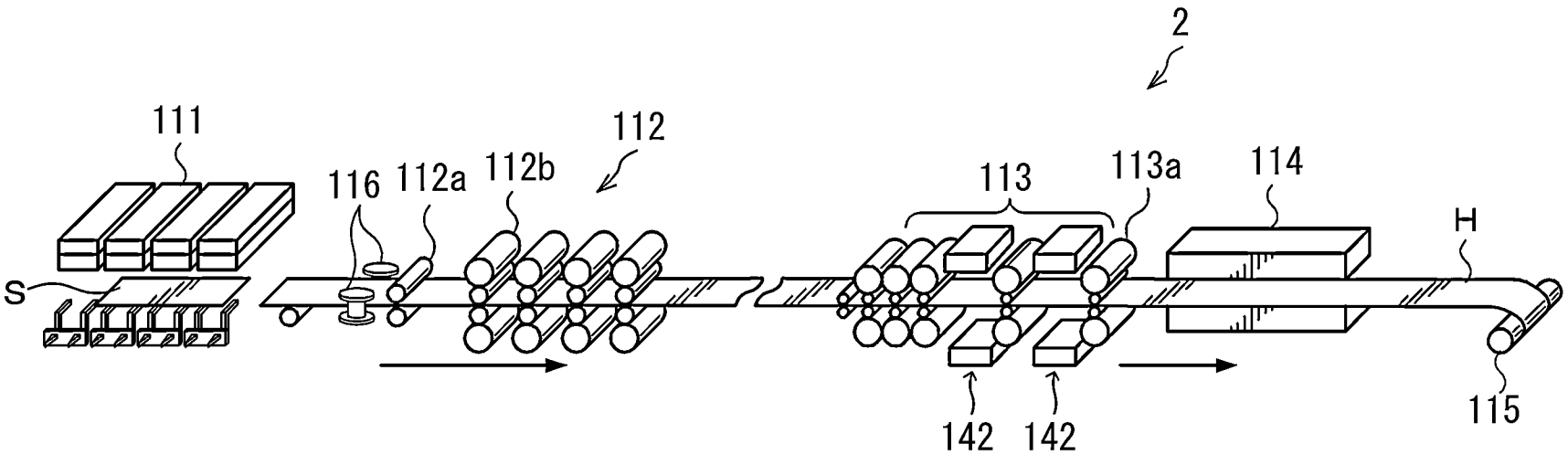
FIG. 16 is an explanatory view illustrating a hot rolling facility 2 for realizing a method for cooling the hot-rolled steel sheet H in another embodiment.

FIG. 16 schematically illustrates an example of a hot rolling facility 2 in another embodiment. The hot rolling facility 2 is a facility aimed to sandwich the top and bottom of a heated slab S using rolls, continuously roll the slab to make the slab as thin as at least 1.2 mm, and coil the slab.

The hot rolling facility 2 has a heating furnace 111 for heating the slab S, a width-direction mill 116 that rolls the slab S heated in the heating furnace 111 in a width direction, a roughing mill 112 that rolls the slab S rolled in the width direction from the vertical direction so as to produce a rough bar, a finishing mill 113 that further continuously hot-finishing-rolls the rough bar to a predetermined thickness, a cooling apparatus 114 that cools the hot-rolled steel sheet H hot-finishing-rolled using the finishing mill 113 using cooling water, and a coiling apparatus 115 that coils the hot-rolled steel sheet H cooled using the cooling apparatus 114 into a coil shape.

The heating furnace 111 is provided with a side burner, an axial burner and a roof burner that heat the slab S brought from the outside through a charging hole by blowing flame. The slab S brought into the heating furnace 111 is sequentially heated in respective heating areas formed in respective zones, and, furthermore, a heat-retention treatment for enabling transportation at an optimal temperature is carried out by uniformly heating the slab S using the roof burner in a soaking area formed in a final zone. When a heating treatment in the heating furnace 111 completely ends, the slab S is transported to the outside of the heating furnace 111, and moved into a rolling process by the roughing mill 112.

In the roughing mill 112, the slab S transported from the heating furnace 111 is passed through gaps between columnar rotary rolls provided across a plurality of stands. For example, the roughing mill 112 hot-rolls the slab S only using work rolls 112*a* provided at the top and bottom of a first stand so as to form a rough bar.

Next, the rough bar which has passed through the work rolls 112*a* is further continuously rolled using a plurality of fourfold mills 112*b* constituted by a work roll and a back-up roll. As a result, when the rough rolling process ends, the rough bar is rolled into a thickness of approximately 30 mm to 60 mm, and transported to the finishing mill 113. Meanwhile, the configuration of the roughing mill 112 is not limited to what has been described in the embodiment, and the number of rolls and the like can be arbitrarily set.

The finishing mill 113 finishing-rolls the rough bar transported from the roughing mill 112 until the thickness becomes approximately several millimeters. The finishing mill 113 passes the rough bar through gaps between top and bottom finish rolling rolls 113*a* linearly arranged across 6 to 7 stands so as to gradually reduce the rough bar. The hot-rolled steel sheet H finishing-rolled using the finishing mill 113 is transported to the cooling apparatus 114 using the transportation rolls 132 (refer to FIG. 17). Meanwhile, a mill having the above-described pair of finish rolling rolls 113*a* linearly arrayed vertically is also referred to as a so-called rolling stand.

In addition, cooling apparatuses 142 (supplementary cooling apparatus) that carry out inter-stand cooling (supplementary cooling) during finish rolling are disposed between the respective rolling rolls 113*a* arrayed across 6 to 7 stands (that is, between the rolling stands). The details of the apparatus configuration and the like of the cooling apparatus 142 will be described below with reference to FIG. 20. Meanwhile, FIG. 16 illustrates a case in which the cooling apparatuses 142 are disposed at two places in the finishing mill 113, but the cooling apparatuses 142 may be provided between all the rolling rolls 113*a*, or may be provided between some of the rolling rolls.

The cooling apparatus 114 is a facility for carrying out nozzle cooling on the hot-rolled steel sheet H transported from the finishing mill 113 through laminating or spraying. As illustrated in FIG. 17, the cooling apparatus 114 has a top side cooling apparatus 114*a* that sprays cooling water from cooling holes 131 on the top side to the top surface of the hot-rolled steel sheet H moving on the transportation rolls 132 in a run-out table, and a bottom side cooling apparatus 114*b* that sprays cooling water from cooling holes 131 on the bottom side to the bottom surface of the hot-rolled steel sheet H.

A plurality of the cooling holes 131 is provided in the top side cooling apparatus 114*a* and the bottom side cooling apparatus 114*b* respectively. In addition, a cooling header (not illustrated) is connected to the cooling holes 131. The number of the cooling holes 131 determines the cooling capabilities of the top side cooling apparatus 114*a* and the bottom side cooling apparatus 114*b*. Meanwhile, the cooling apparatus 114 may be constituted by at least one of a top and bottom split laminar, a pipe laminar, spray cooling and the like.

In the cooling apparatus 114, when adjusting the cooling capability of the top side cooling apparatus 114*a* and the cooling capability of the bottom side cooling apparatus 114*b*, for example, the cooling headers connected to cooling holes 131 in the top side cooling apparatus 114*a* and the cooling headers connected to cooling holes 131 in the bottom side cooling apparatus 114*b* may be on-off controlled respectively.

Alternatively, the operation parameters of the respective cooling headers in the top side cooling apparatus 114*a* and the bottom side cooling apparatus 114*b* may be controlled. That is, at least one of the sprayed water density, pressure and water temperature of cooling water sprayed from the respective cooling holes 131 may be adjusted.

In addition, the flow rate or pressure of cooling water sprayed from the top side cooling apparatus 114*a* and the bottom side cooling apparatus 114*b* may be adjusted by thinning out the cooling headers (cooling holes 131) of the top side cooling apparatus 114*a* and the bottom side cooling apparatus 114*b*. For example, in a case in which the cooling capability of the top side cooling apparatus 114*a* before thinning out the cooling headers is superior to the cooling capability of the bottom side cooling apparatus 114*b*, the cooling headers that constitute the top side cooling apparatus 114*a* are preferably thinned out.

The coiling apparatus 115 coils the hot-rolled steel sheet H cooled using the cooling apparatus 114 at a predetermined coiling temperature as illustrated in FIG. 16. The hot-rolled steel sheet H coiled into a coil shape using the coiling apparatus 115 is transported to the outside of the hot rolling facility 2.

In a case in which the hot-rolled steel sheet H having a wave shape with a surface height (wave height) changing in the rolling direction is cooled in the cooling apparatus 114 of the hot rolling facility 2 constituted as described above, it is possible to uniformly cool the hot-rolled steel sheet H by appropriately adjusting the water quantity densities, pressures, water temperatures and the like of cooling water sprayed from the top side cooling apparatus 114*a* and cooling water sprayed from the bottom side cooling apparatus 114*b* as described above. However, particularly, in a case in which the sheet-threading speed of the hot-rolled steel sheet H is slow, a period of time during which the hot-rolled steel sheet H and the transportation rolls 132 or aprons 133 locally come into contact with each other becomes long, and the contact portions of the hot-rolled steel sheet H with the transportation rolls 132 or the aprons 133 become easily coolable due to heat dissipation by contact, and therefore cooling becomes ununiform. The causes of the ununiformity of the cooling will be described below with reference to the accompanying drawings.

Figure 18A:
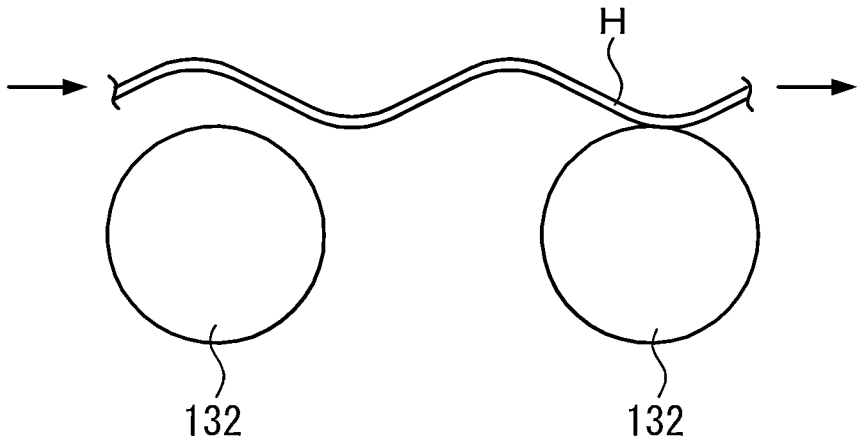
FIG. 18A is an explanatory view illustrating a shape in which a bottom point of the hot-rolled steel sheet H comes into contact with a transportation roll 132.
Figure 18B:
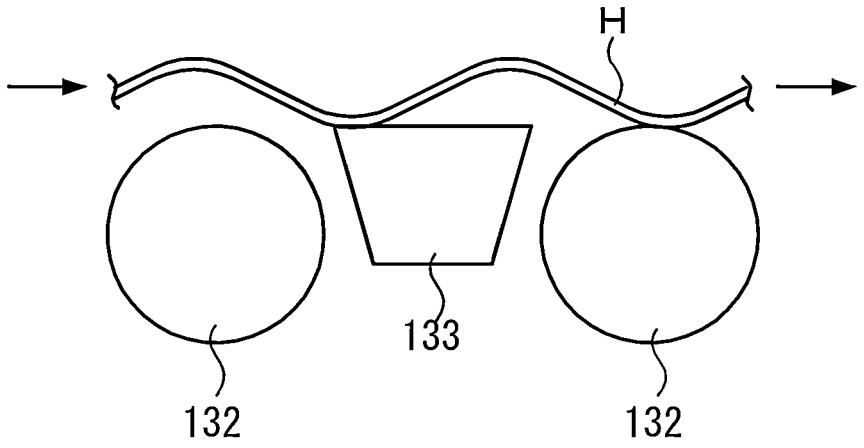
FIG. 18B is an explanatory view illustrating a shape in which the bottom point of the hot-rolled steel sheet H comes into contact with the transportation roll 132 and an apron 133.

As illustrated in FIG. 18A, in a case in which the hot-rolled steel sheet H has a wave shape in the rolling direction, there is a possibility of the bottom portion of the wave shape of the hot-rolled steel sheet H locally coming into contact with the transportation rolls 132. In addition, there are cases in which the apron 133 is provided between the adjacent transportation rolls 132 in the rolling direction as a support for preventing the hot-rolled steel sheet H from dropping as illustrated in FIG. 18B. In this case, there is a possibility of the bottom portion of the wave shape of the hot-rolled steel sheet H locally corning into contact with the transportation rolls 132 and the aprons 133. As such, in the hot-rolled steel sheet H, portions that locally come into contact with the transportation rolls 132 or the aprons 133 become more easily coolable than other portions due to heat dissipation by contact. Therefore, the hot-rolled steel sheet H is ununiformly cooled.

Figure 19A:
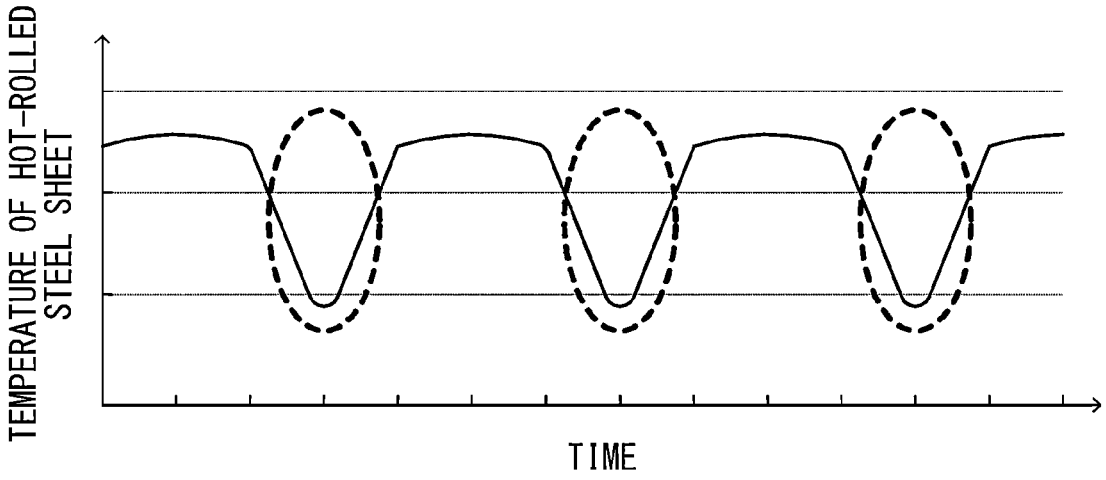
FIG. 19A is a graph illustrating a change of the temperature of the hot-rolled steel sheet H over time in a case in which the sheet-threading speed of the hot-rolled steel sheet H is slow.

Particularly, in a case in which the sheet-threading speed of the hot-rolled steel sheet H is slow, a period of time during which the hot-rolled steel sheet H locally comes into contact with the transportation rolls 132 or the aprons 133 becomes long. As a result, portions at which the hot-rolled steel sheet H locally comes into contact with the transportation rolls 132 or the aprons 133 (portions surrounded by the dotted line in FIG. 19A) become more easily coolable than other portions as illustrated in FIG. 19A, and the hot-rolled steel sheet H is ununiformly cooled.

On the other hand, when the sheet-threading speed of the hot-rolled steel sheet H is set to a high speed, the contact period of time becomes short. Furthermore, when the sheet-threading speed is increased, the hot-rolled steel sheet H in the process of sheet threading becomes floated from the transportation rolls 132 or the aprons 133 due to repulsion by the contact between the hot-rolled steel sheet H and the transportation rolls 132 or the aprons 133.

In addition, when the sheet-threading speed is increased, the hot-rolled steel sheet H does not only become floated from the transportation rolls 132 or the aprons 133 due to repulsion by the contact, but the contact period of time or number of contacts between the hot-rolled steel sheet H and the transportation rolls 132 or the aprons 133 also decreases, and therefore the temperature decrease by the contact becomes negligible.

Figure 19B:
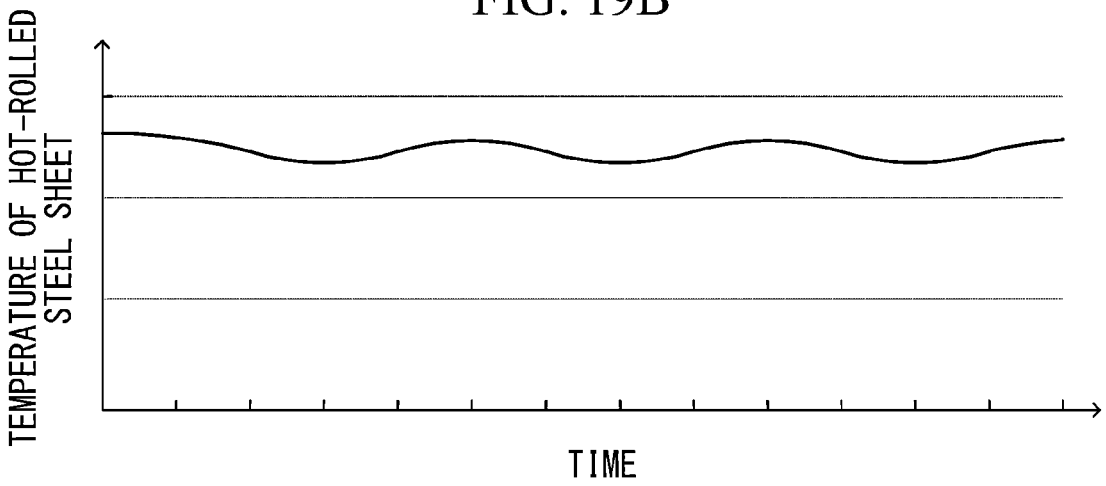
FIG. 19B is a graph illustrating a change of the temperature of the hot-rolled steel sheet H over time in a case in which the sheet-threading speed of the hot-rolled steel sheet H is high.

Therefore, the heat dissipation by contact can be suppressed by increasing the sheet-threading speed, and the hot-rolled steel sheet H can be more uniformly cooled as illustrated in FIG. 19B. In addition, the inventors found that the hot-rolled steel sheet H can be sufficiently uniformly cooled by setting the sheet-threading speed to 550 m/min or more.

Meanwhile, the above finding is about the cooling of the hot-rolled steel sheet H having a wave shape; however, regardless of the height of the wave shape, the lowermost point of the hot-rolled steel sheet H comes into contact with the transportation rolls 132 or the aprons 133, and therefore, regardless of the height of the wave shape, an increase in the sheet-threading speed is effective for uniform cooling.

In addition, when the sheet-threading speed of the hot-rolled steel sheet H is set to 550 m/min or more, since the hot-rolled steel sheet H becomes floated from the transportation rolls 132 or the aprons 133, there is no soaked water on the hot-rolled steel sheet H as in the related art even when cooling water is sprayed onto the hot-rolled steel sheet H in the above state. Therefore, it is possible to prevent the hot-rolled steel sheet H from being ununiformly cooled due to soaked water.

As described above, when the sheet-threading speed of the hot-rolled steel sheet H in the cooling section is set to 550 m/min or more in addition to the above-described control of the amount of heat dissipated from the top and bottom surfaces, it is possible to more uniformly cool the hot-rolled steel sheet H having a wave shape with a height periodically changing in the rolling direction.

Meanwhile, the sheet-threading speed of the hot-rolled steel sheet H is preferably faster, but it is impossible to exceed the mechanical limit speed (for example, 1550 m/min). Therefore, practically, the sheet-threading speed of the hot-rolled steel sheet H in the cooling section is set in a range of 550 m/min to the mechanical limit speed. In addition, in a case in which the upper limit value of the sheet-threading speed during actual operation (operation upper limit speed) is set in advance, the sheet-threading speed of the hot-rolled steel sheet H is preferably set in a range of 550 m/min to the operation upper limit speed (for example, 1200 m/min).

The setting of the sheet-threading speed to a high speed (set in a range from 550 m/min to the mechanical limit speed) may be reliably combined into the method for cooling a hot-rolled steel sheet described using FIGS. 1 to 14.

In addition, in general, in the case of the hot-rolled steel sheet H having a large tensile strength (particularly, a steel sheet or the like called a so-called high tensile strength steel having a tensile strength (TS) of 800 MPa or more and a realistic upper limit of 1400 MPa), it is known that heat generation by working occurring in the hot rolling facility 2 during rolling is increased due to a high hardness of the hot-rolled steel sheet H. Therefore, in the related art, the hot-rolled steel sheet H was sufficiently cooled by suppressing the sheet-threading speed of the hot-rolled steel sheet H in the cooling apparatus 114 (that is, the cooling section) to be low.

However, when the sheet-threading speed of the hot-rolled steel sheet H in the cooling apparatus 114 is suppressed to be low, in a case in which a wave shape is formed in the hot-rolled steel sheet H, the local contacts between the hot-rolled steel sheet H and the transportation rolls 132 or the aprons 133 make the contact portions more easily coolable due to heat dissipation by contact as described above, the hot-rolled steel sheet is ununiformly cooled.

Therefore, the inventors found that, when cooling is carried out between a pair of finish rolling rolls 113*a* (that is, rolling stands) provided across, for example, 6 to 7 stands in the finishing mill 113 of the hot rolling facility 2 (so-called inter-stand cooling), the heat dissipation by working can be suppressed, and the sheet-threading speed of the hot-rolled steel sheet H in the cooling apparatus 114 can be set to 550 m/min or more. Hereinafter, the inter-stand cooling will be described with reference to FIG. 20.

Figure 20:
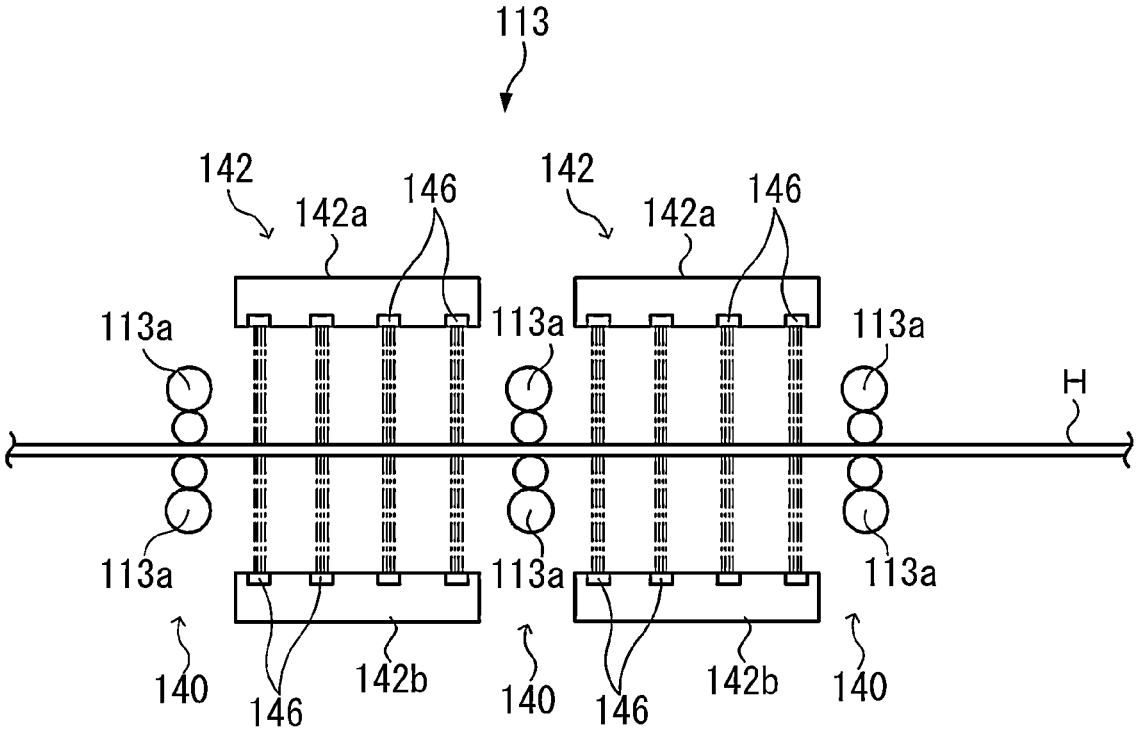
FIG. 20 is an explanatory view of a finishing mill 113 that can carry out inter-stand cooling.

FIG. 20 is an explanatory view of the finishing mill 113 that can carry out the inter-stand cooling, in which a part of the finishing mill 113 is enlarged for the description and three rolling stands are illustrated. Meanwhile, in FIG. 20, the same components as in the above embodiment will be given the same reference numeral. As illustrated in FIG. 20, a plurality (three in FIG. 20) of rolling stands 140 having a pair of vertically linearly arrayed finish rolling rolls 113*a* and the like is provided in the finishing mill 113. The cooling apparatuses 142 which are facilities that carry out nozzle cooling through lamination or spraying are provided between the respective rolling stands 140, which make it possible to carry out the inter-stand cooling on the hot-rolled steel sheet H between the rolling stands 140.

The cooling apparatus 142 has a top side cooling apparatus 142*a* that sprays cooling water from the top side through cooling holes 146 onto the hot-rolled steel sheet H transported in the finishing mill 113 and a bottom side cooling apparatus 142*b* that sprays cooling water from the bottom side onto the hot-rolled steel sheet H as illustrated in FIG. 20. A plurality of the cooling hole 146 is provided respectively in the top side cooling apparatus 142*a* and the bottom side cooling apparatus 142*b*. In addition, a cooling header (not illustrated) is connected to the cooling hole 146. Meanwhile, the cooling apparatus 142 may be constituted by at least one of a top and bottom split laminar, a pipe laminar, spray cooling and the like.

In the finishing mill 113 having the configuration illustrated in FIG. 20, particularly, in a case in which the tensile strength (TS) of the hot-rolled steel sheet H is 800 MPa or more, the heat dissipation by working in the hot-rolled steel sheet H is suppressed by carrying out the inter-stand cooling. Thereby, it becomes possible to maintain the sheet-threading speed of the hot-rolled steel sheet H in the cooling apparatus 114 at 550 m/min or more. Therefore, the problem of the related art caused in a case in which cooling was carried out at a slow sheet-threading speed, which was the local contacts between the hot-rolled steel sheet H and the transportation rolls 132 or the aprons 133 and the contact portions becoming more easily coolable due to heat dissipation by contact is solved, and the hot-rolled steel sheet H can be sufficiently uniformly cooled.

In the above embodiment, the cooling of the hot-rolled steel sheet H using the cooling apparatus 114 is preferably carried out in a temperature range of the hot-rolled steel sheet H of 600° C. or higher. The temperature range in which the temperature of the hot-rolled steel sheet H becomes 600° C. or higher is a so-called film boiling range. That is, in this case, it is possible to avoid the so-called transition boiling area and to cool the hot-rolled steel sheet H in the film boiling area. In the transition boiling area, when cooling water is sprayed onto the surface of the hot-rolled steel sheet H, portions covered with a vapor film and portions in which the cooling water is directly sprayed onto the hot-rolled steel sheet H are present in a mixed state on the surface of the hot-rolled steel sheet H. Therefore, it is not possible to uniformly cool the hot-rolled steel sheet H.

On the other hand, in the film boiling area, since the hot-rolled steel sheet H is cooled in a state in which the entire surface of the hot-rolled steel sheet H is covered with a vapor film, it is possible to uniformly cool the hot-rolled steel sheet H. Therefore, it is possible to more uniformly cool the hot-rolled steel sheet H in a range in which the temperature of the hot-rolled steel sheet H is 600° C. or higher as in the embodiment.

Thus far, the preferable embodiment of the present invention has been described with reference to the accompanying drawings, but the present invention is not limited to the above embodiment. It is evident that a person skilled in the art can imagine a variety of modified examples and corrected examples within the scope of ideas described in the claims, and it is needless to say that the examples belong to the technical scope of the present invention.

EXAMPLES

The inventors carried out cooling tests of a hot-rolled steel sheet as examples in order to verify that the hot-rolled steel sheet could be uniformly cooled by setting the sheet-threading speed of the hot-rolled steel sheet to 550 m/min or more.

Example 1

Hot-rolled steel sheets with a middle wave having a sheet thickness of 2.5 mm, a width of 1200 mm, a tensile strength of 400 MPa and a steepness of 2% were cooled with varying sheet-threading speeds in a cooling apparatus. Specifically, the sheet-threading speeds were 400 m/min, 450 m/min, 500 m/min, 550 m/min, 600 m/min and 650 m/min, and the hot-rolled steel sheets were cooled at the respective sheet-threading speeds 20 times.

In addition, the temperatures of the hot-rolled steel sheets during coiling were measured, and an average value (CT temperature change amount) of the standard deviations of temperature changes was computed using the temperature measurement results. The evaluation results of the computed CT temperature change amount are described in Table 3 below. Meanwhile, in terms of the evaluation criteria, a case in which the CT temperature change amount was larger than 25° C. was evaluated as ununiform cooling, and a case in which the CT temperature change amount was 25° C. or less was evaluated as uniform cooling.

TABLE 5

| | Sheet-threading speed [m/min] | | | | | |
|---|---|---|---|---|---|---|
| | 400 | 450 | 500 | 550 | 600 | 650 |
| Exit-side finishing temperature [° C.] | 830 | 850 | 870 | 890 | 910 | 930 |
| CT temperature change amount [° C.] | 58 | 37 | 32 | 12 | 8 | 6 |
| Evaluation | C | C | C | B | A | A |

An inter-stand cooling was not carried out under all conditions.
Evaluation
C: CT > 25° C.
B: 25 ≥ CT ≥ 10
A: 10 > CT As described in Table 5, in a case in which the sheet-threading speed is 500 m/min or less, the CT temperature change amount is not sufficiently reduced (higher than 25° C.), and the hot-rolled steel sheet is not sufficiently uniformly cooled. On the other hand, in a case in which the sheet-threading speed is 550 m/min or more, it was found that the CT temperature change amount is suppressed to 25° C. or less, and the hot-rolled steel sheet is uniformly cooled. Meanwhile, in a case in which the sheet-threading speed is 600 m/min or more, it was found that, since the CT temperature was suppressed to lower than 10° C. (8° C. and 6° C.), the above condition is more preferable for the uniform cooling of the hot-rolled steel sheet.

Example 2

The inter-stand cooling was carried out on hot-rolled steel sheets with a middle wave having a sheet thickness of 2.5 mm, a width of 1200 mm, a tensile strength of 800 MPa and a steepness of 2% so that the exit-side temperature of finish rolling became 880° C., and cooling was carried out with varying sheet-threading speeds in a cooling apparatus. Specifically, the sheet-threading speeds were 400 m/min, 450 m/min, 500 m/min, 550 m/min, 600 m/min and 650 m/min, and the hot-rolled steel sheets were cooled at the respective sheet-threading speeds 20 times.

In addition, the temperatures of the hot-rolled steel sheets during coiling were measured, and an average value (CT temperature change amount) of the standard deviations of temperature changes was computed using the temperature measurement results. The evaluation results of the computed CT temperature change amount are described in Table 4 below. Meanwhile, the same evaluation criteria as in Example 1 were used, and the inter-stand cooling was not carried out only in a case in which the sheet-threading speed was 400 m/min.

TABLE 6

| | Sheet-threading speed [m/min] | | | | | |
|---|---|---|---|---|---|---|
| | 400 | 450 | 500 | 550 | 600 | 650 |
| Inter-stand cooling | No | Yes | Yes | Yes | Yes | Yes |
| CT temperature change amount [° C.] | 62 | 43 | 28 | 10 | 6 | 6 |
| Evaluation | C | C | C | B | A | A |

An inter-stand cooling was appropriately carried out so that the exit-side temperature after finishing rolling became 880° C.
Evaluation
C: CT > 25° C.
B: 25 ≥ CT ≥ 10
A: 10 > CT As described in Table 6, in a case in which the sheet-threading speed was 500 m/min or less, even when the inter-stand cooling was carried out, the CT temperature change amount was not sufficiently reduced (higher than 25° C.), and the hot-rolled steel sheet was not sufficiently uniformly cooled. On the other hand, in a case in which the sheet-threading speed was 500 m/min or more, it was found that the CT temperature change amount was suppressed to 25° C. or less, and the hot-rolled steel sheet was uniformly cooled.

In addition, in cases in which the inter-stand cooling was carried out (that is, the cases described in Table 6), the CT temperature change amount was suppressed even in the hot-rolled steel sheets having a relatively high hardness (tensile strength 800 MPa). That is, it was found that it became possible to uniformly cool all steel materials, particularly, steel materials having a high hardness by setting the sheet-threading speed during the cooling of the hot-rolled steel sheet to 550 m/min or more, and, additionally, carrying out the inter-stand cooling in a finishing mill.

INDUSTRIAL APPLICABILITY

The present invention is useful when cooling a hot-rolled steel sheet which has been hot-rolled using a finishing mill so as to have a wave shape having a surface height changing in the rolling direction.

DESCRIPTION OF REFERENCE NUMERALS AND SIGNS

1, 2: HOT ROLLING FACILITY
11, 111: HEATING FURNACE
12, 112: ROUGHING MILL
12*a*, 112*a*: WORK ROLL
12*b*, 112*b*: FOURFOLD MILL
13, 113: FINISHING MILL
13*a*, 113*a*: FINISH ROLLING ROLL
14, 114: COOLING APPARATUS
14*a*, 114*a*: TOP SIDE COOLING APPARATUS
14*b*, 114*b*: BOTTOM SIDE COOLING APPARATUS
15, 115: COILING APPARATUS
16, 116: WIDTH-DIRECTION MILL
31, 131: COOLING HOLE
32, 132: TRANSPORTATION ROLL
40: THERMOMETER
41: SHAPE METER
H: HOT-ROLLED STEEL SHEET
S: SLAB
Z1, Z2: DIVIDED COOLING SECTION

The invention claimed is:

1. A method for cooling a hot-rolled steel sheet in which a hot-rolled steel sheet hot-rolled using a finishing mill is cooled in a cooling section provided on a sheet-threading path, the method comprising:

a target ratio-setting process in which a heat transfer coefficient ratio X1 is set as a target ratio Xt based on correlation data indicating a correlation between a top and bottom heat transfer coefficient ratio X and a temperature standard deviation Y of temperatures measured across a length of the hot-rolled steel sheet;

a cooling control process in which at least one of an amount of heat dissipated from a top surface by cooling and an amount of heat dissipated from a bottom surface by cooling of the hot-rolled steel sheet in the cooling section is controlled so that heat transfer coefficient ratio X matches target ratio Xt;

a temperature-measuring process in which a temperature of the hot-rolled steel sheet is measured in chronological order on a downstream side of the cooling section;

a changing speed-measuring process in which a changing speed of the hot-rolled steel sheet in a vertical direction is measured in chronological order at a same place as a temperature measurement place of the hot-rolled steel sheet on the downstream side of the cooling section;

a control direction-determining process in which, when an upward side of the vertical direction of the hot-rolled steel sheet is set as positive, in an area with a positive changing speed, in a case in which a temperature of the hot-rolled steel sheet is lower than an average temperature in a range of one or more cycles of a wave shape of the hot-rolled steel sheet, at least one of a direction in which the amount of heat dissipated from the top surface by cooling decreases and a direction in which the amount of heat dissipated from the bottom surface by cooling increases is determined as a control direction, in a case in which the temperature of the hot-rolled steel sheet is higher than the average temperature, at least one of a direction in which the amount of heat dissipated from the top surface by cooling increases and a direction in which the amount of heat dissipated from the bottom surface by cooling decreases is determined as the control direction, in an area with a negative changing speed, in a case in which the temperature of the hot-rolled steel sheet is lower than the average temperature, at least one of a direction in which the amount of heat dissipated from the top surface by cooling increases and a direction in which the amount of heat dissipated from the bottom surface by cooling decreases is determined as the control direction, and, in a case in which the temperature of the hot-rolled steel sheet is higher than the average temperature, at least one of a direction in which the amount of heat dissipated from the top surface by cooling decreases and a direction in which the amount of heat dissipated from the bottom surface by cooling increases is determined as the control direction; and an amount of heat dissipated by cooling-adjusting process in which at least one of the amount of heat dissipated from the top surface by cooling and the amount of heat dissipated from the bottom surface by cooling of the hot-rolled steel sheet in the cooling section is adjusted based on the control direction determined in the control direction-determining process, wherein:

heat transfer coefficient ratio X is a ratio of heat transfer coefficients of top and bottom surfaces of the hot-rolled steel sheet, temperature standard deviation Y is the temperature standard deviation during or after cooling of the hot-rolled steel sheet under conditions in which steepness and sheet-threading speed of the hot-rolled steel sheet are constant values, and heat transfer coefficient X1 is a top and bottom heat transfer coefficient ratio at which the temperature standard deviation Y becomes a minimum value Ymin.

2. The method for cooling a hot-rolled steel sheet according to claim 1, wherein, in the target ratio-setting process, a top and bottom heat transfer coefficient ratio X at which the temperature standard deviation Y converges in a range of the minimum value Ymin to the minimum value Ymin+10° C. is set as the target ratio Xt based on the correlation data.

3. The method for cooling a hot-rolled steel sheet according to claim 2, wherein the correlation data indicating a correlation between the heat transfer coefficient ratio X and the temperature standard deviation Y is obtained under a plurality of steepness and sheet-threading speed conditions, and, in the target ratio-setting process, the target ratio Xt is set based on correlation data matching actually measured values of the steepness and the sheet-threading speed of a plurality of correlation data.

4. The method for cooling a hot-rolled steel sheet according to claim 1, wherein the correlation data indicating a correlation between the heat transfer coefficient ratio X and the temperature standard deviation Y is obtained under a plurality of steepness and sheet-threading speed conditions, and, in the target ratio-setting process, the target ratio Xt is set based on correlation data matching actually measured values of the steepness and the sheet-threading speed of a plurality of correlation data.

5. The method for cooling a hot-rolled steel sheet according to claim 4, wherein the correlation data are data indicating a correlation between the top and bottom heat transfer coefficient ratio X and the temperature standard deviation Y using a regression formula.

6. The method for cooling a hot-rolled steel sheet according to claim 5, wherein the regression formula is a formula derived using linear regression.

7. The method for cooling a hot-rolled steel sheet according to claim 4, wherein the correlation data are data indicating a correlation between the top and bottom heat transfer coefficient ratio X and the temperature standard deviation Y using a table.

8. The method for cooling a hot-rolled steel sheet according to claim 1, wherein the cooling section is divided into a plurality of divided cooling sections in a sheet-threading direction of the hot-rolled steel sheet, the temperature and changing speed of the hot-rolled steel sheet are measured in chronological order at each of borders of the divided cooling sections in the temperature-measuring process and the changing speed-measuring process;

increase and decrease directions of the amounts of heat dissipated by cooling from the top and bottom surfaces of the hot-rolled steel sheet are determined for the respective divided cooling sections based on measurement results of the temperature and changing speeds of the hot-rolled steel sheet at the respective borders of the divided cooling sections in the control direction-determining process; and feedback control or feedforward control is carried out in order to adjust at least one of the amount of heat dissipated from the top surface by cooling and the amount of heat dissipated from the bottom surface by cooling of the hot-rolled steel sheet at each of the divided cooling sections based on the control direction determined for each of the divided cooling sections in the amount of heat dissipated by cooling-adjusting process.

9. The method for cooling a hot-rolled steel sheet according to claim 8, the method further comprising:

a measuring process in which the steepness or sheet-threading speed of the hot-rolled steel sheet is measured at each of the borders of the divided cooling sections; and an amount of heat dissipated by cooling-correcting process in which at least one of the amount of heat dissipated from the top surface by cooling and the amount of heat dissipated from the bottom surface by cooling of the hot-rolled steel sheet is corrected at each of the divided cooling sections based on measurement results of the steepness or the sheet-threading speeds.

10. The method for cooling a hot-rolled steel sheet according to claim 1, the method further comprising:

a post-cooling process in which the hot-rolled steel sheet is further cooled on a downstream side of the cooling section in order to make the temperature standard deviation of the hot-rolled steel sheet fall into a permissible range.

11. The method for cooling a hot-rolled steel sheet according to claim 1, wherein the sheet-threading speed of the hot-rolled steel sheet in the cooling section is set in a range of 550 m/min to 1550 m/min.

12. The method for cooling a hot-rolled steel sheet according to claim 11, wherein the finishing mill is constituted by a plurality of rolling stands, and a supplementary cooling process in which the hot-rolled steel sheet is supplementarily cooled between the plurality of rolling stands is further provided.

13. The method for cooling a hot-rolled steel sheet according to claim 1, wherein a top side cooling apparatus having a plurality of headers that ejects cooling water to a top surface of the hot-rolled steel sheet and a bottom side cooling apparatus having a plurality of headers that ejects cooling water to a bottom surface of the hot-rolled steel sheet are provided in the cooling section, and the amount of heat dissipated from the top surface by cooling and the amount of heat dissipated from the bottom surface by cooling are adjusted by carrying out on-off control of the respective headers.

14. The method for cooling a hot-rolled steel sheet according to claim 1, wherein a top side cooling apparatus having a plurality of headers that ejects cooling water to a top surface of the hot-rolled steel sheet and a bottom side cooling apparatus having a plurality of headers that ejects cooling water to a bottom surface of the hot-rolled steel sheet are provided in the cooling section, and the amount of heat dissipated from the top surface by cooling and the amount of heat dissipated from the bottom surface by cooling are adjusted by controlling at least one of sprayed water density, pressure and water temperature of each of the headers.

15. The method for cooling a hot-rolled steel sheet according to claim 1, wherein a temperature of the hot-rolled steel sheet is in a range of 600° C. or higher before the cooling section.

* * * * *